US007421229B2

(12) United States Patent
Tomiie et al.

(10) Patent No.: US 7,421,229 B2
(45) Date of Patent: Sep. 2, 2008

(54) IMAGE FORMING APPARATUS

(75) Inventors: Norio Tomiie, Osaka (JP); Akane Tokushige, Osaka (JP)

(73) Assignee: Kyocera Mita Corporation (JP)

( * ) Notice: Subject to any disclaimer, the term of this patent is extended or adjusted under 35 U.S.C. 154(b) by 389 days.

(21) Appl. No.: 11/359,231

(22) Filed: Feb. 21, 2006

(65) Prior Publication Data

US 2006/0188288 A1 Aug. 24, 2006

(30) Foreign Application Priority Data

Feb. 22, 2005 (JP) ..... 2005-045328
Feb. 22, 2005 (JP) ..... 2005-045334
Jan. 12, 2006 (JP) ..... 2006-004820

(51) Int. Cl.
*G03G 21/06* (2006.01)

(52) U.S. Cl. ..... 399/128

(58) Field of Classification Search ..... 399/32, 399/128, 186, 187
See application file for complete search history.

(56) References Cited

U.S. PATENT DOCUMENTS 5,065,188 A * 11/1991 Kobayashi et al. ..... 399/186
6,330,413 B1 * 12/2001 Yamamoto et al. ..... 399/186

FOREIGN PATENT DOCUMENTS

JP 06161223 A * 6/1994
JP 8-272270 10/1996

* cited by examiner

*Primary Examiner*—Ryan Gleitz
(74) *Attorney, Agent, or Firm*—Gerald E. Hespos; Anthony J. Casella

(57) ABSTRACT

Charge removing light is guided by an optical path defining member (623) from a charge removing unit (6) toward a photosensitive drum (2). A distance between an end surface (623*e*) of the optical path defining member (623) and a surface on an axially central part of the photosensitive drum (2) is less than a distance between the end surface (623*e*) and the surface on the axially opposite ends of the photosensitive drum (2). Thus an irradiation width and an amount of the charge removing light projected onto the surface of the photosensitive drum (2) are increased on the opposite ends. With this arrangement, the amount of generated light carriers can be reduced on the axially central part, as compared with the axially opposite ends, and a surface potential distribution non-uniformity due to a difference in nip distance between the photosensitive drum (2) and a charging roller (31) can be eliminated.

21 Claims, 13 Drawing Sheets

IMAGE FORMING APPARATUS

BACKGROUND OF THE INVENTION

1. Field of the Invention

The present invention relates to an image forming apparatus provided with a photoconductor, particularly, an amorphous silicon (a-Si) photosensitive drum for charging a surface of the photosensitive drum by contact charging.

2. Description of the Related Art

Heretofore, a device for electrostatically charging a drum-type electrophotographic photoconductor (hereinafter, simply called as "photosensitive drum") has been composed of a corona charging device designed to expose a surface of a photosensitive drum to corona charge so as to electrostatically charge the surface. In recent years, from the aspect of advantages in lower-level ozone formation and lower power consumption as compared with the corona charging device, a contact charging type image forming apparatus, designed to bring a charging member such as a charging roller in a voltage-applied state into contact with a surface of a photosensitive drum so as to electrostatically charge the surface has come into practical use (see e.g. Japanese Unexamined Patent Publication No. 8-272270).

Further, in place of selenium or OPC (Organic Photo Conductor) conventionally used as a material for a surface layer of a photosensitive drum, an amorphous silicon (a-Si) photoconductor using an amorphous silicon is recently beginning to be used in view of environmental concerns, longer life duration, etc.

The contact charging type image forming apparatus has the following drawbacks. Generally, a conductive rubber roller i.e. a charging roller containing an ion conductive agent is pressingly contacted with a photosensitive drum to realize the contact charging. In pressing the surface of the photosensitive drum by the charging roller, a load exerted to an axially central part of the photosensitive drum is essentially smaller than a load exerted to the axially opposite ends thereof, with the result that a nip width between the photosensitive drum and the charging roller is narrow on the axially central part of the photosensitive drum, as compared with the axially opposite ends thereof. This may lead to a lower charging potential on the axially central part, as compared with the axially opposite ends, which may cause a surface potential distribution non-uniformity of the photosensitive drum, and resultantly cause image formation failure such as fog. The following approach is known to eliminate the drawback. Specifically, a bias voltage generated by superimposing an AC voltage to a DC voltage is applied to the charging roller to suppress the surface potential distribution non-uniformity due to the nip distance difference.

In the case where an amorphous silicon photoconductor is used, a nip distance difference between the charging roller and the photosensitive drum greatly affects the surface potential distribution of the photosensitive drum. This is because the amorphous silicon photoconductor has a lower chargeability as compared with an organic photoconductor such as OPC. Accordingly, the surface potential distribution non-uniformity cannot be sufficiently eliminated even by the approach of superimposing the AC bias voltage in the image forming apparatus provided with the amorphous silicon photosensitive drum.

Further, there is a case that a surface potential of a photosensitive drum may be fluctuated due to a charge removing light amount distribution non-uniformity. A generally used charge removing device has, as a light source, an LED array having LEDs (light emitting diodes) in the order of about 15 to 40, which are arrayed in a direction of a rotational axis of a photosensitive drum for emitting charge removing light to project the charge removing light toward the surface of the photosensitive drum axially linearly. If the charge removing light emitted from the LED array is projected axially uniformly onto the surface of the photosensitive drum, the chargeability of the photosensitive drum is made uniform. If, however, the amount of the charge removing light is fluctuated axially, a charging fluctuation may occur, which may cause a surface potential distribution non-uniformity of the photosensitive drum, and resultantly lead to image formation failure such as fog.

SUMMARY OF THE INVENTION

In view of the above problems residing in the prior art, it is an object of the present invention to provide a contact charging type image forming apparatus equipped with a photoconductor, particularly, an amorphous silicon photosensitive drum, which is capable of substantially uniformly keeping a surface potential of the photoconductor in a direction of a rotational axis thereof, and to prevent occurrence of image formation failure such as fog.

In order to achieve this object, the prevent invention provides an image forming apparatus for forming an image by transferring a toner image onto a transfer member. The image forming apparatus comprises: a photoconductor, rotatably supported about a rotational axis thereof, for forming an electrostatic latent image on a surface of the photoconductor, and forming a toner image on the surface of the photoconductor by attracting a toner onto the electrostatic latent image; a charger for charging the photoconductor by contact charging; and a charge remover for removing charge residues from the surface of the photoconductor after the toner image is transferred from the surface of the photoconductor onto the transfer member, wherein the charge remover includes a light source for emitting a certain amount of charge removing light; and a light guiding member for linearly projecting the charge removing light onto the surface of the photoconductor. The light guiding member has an incident end facing the light source, and an exit end facing the surface of the photoconductor. The light guiding member is operative to control the amount of the charge removing light to be projected onto the surface of the photoconductor in a direction of the rotational axis of the photoconductor.

With the above arrangement, the light guiding member for guiding the charge removing light is provided between the light source and the photoconductor, and the light guiding member is operative to control the amount of the charge removing light to be projected onto the surface of the photoconductor. This arrangement enables to control the charge removing light amount with use of the light guiding member, considering a nip distance difference between the photoconductor and the charger, a charge removing light amount fluctuation, and the like. Accordingly, this arrangement secures image formation without an image formation failure, while suppressing occurrence of a surface potential distribution non-uniformity of the photoconductor.

These and other objects, features and advantages of the present invention will become more apparent upon reading of the following detailed description along with the accompanying drawings.

BRIEF DESCRIPTION OF THE DRAWINGS

FIGS. 10A and 10B are cross-sectional view of an optical path defining member in the second embodiment, wherein FIG. 10A is a cross-sectional view taken along the line L2 in FIG. 9, and FIG. 10B is a cross-sectional view taken along the line L1 in FIG. 9.

DETAILED DESCRIPTION OF THE PREFERRED EMBODIMENTS

Figure 1:
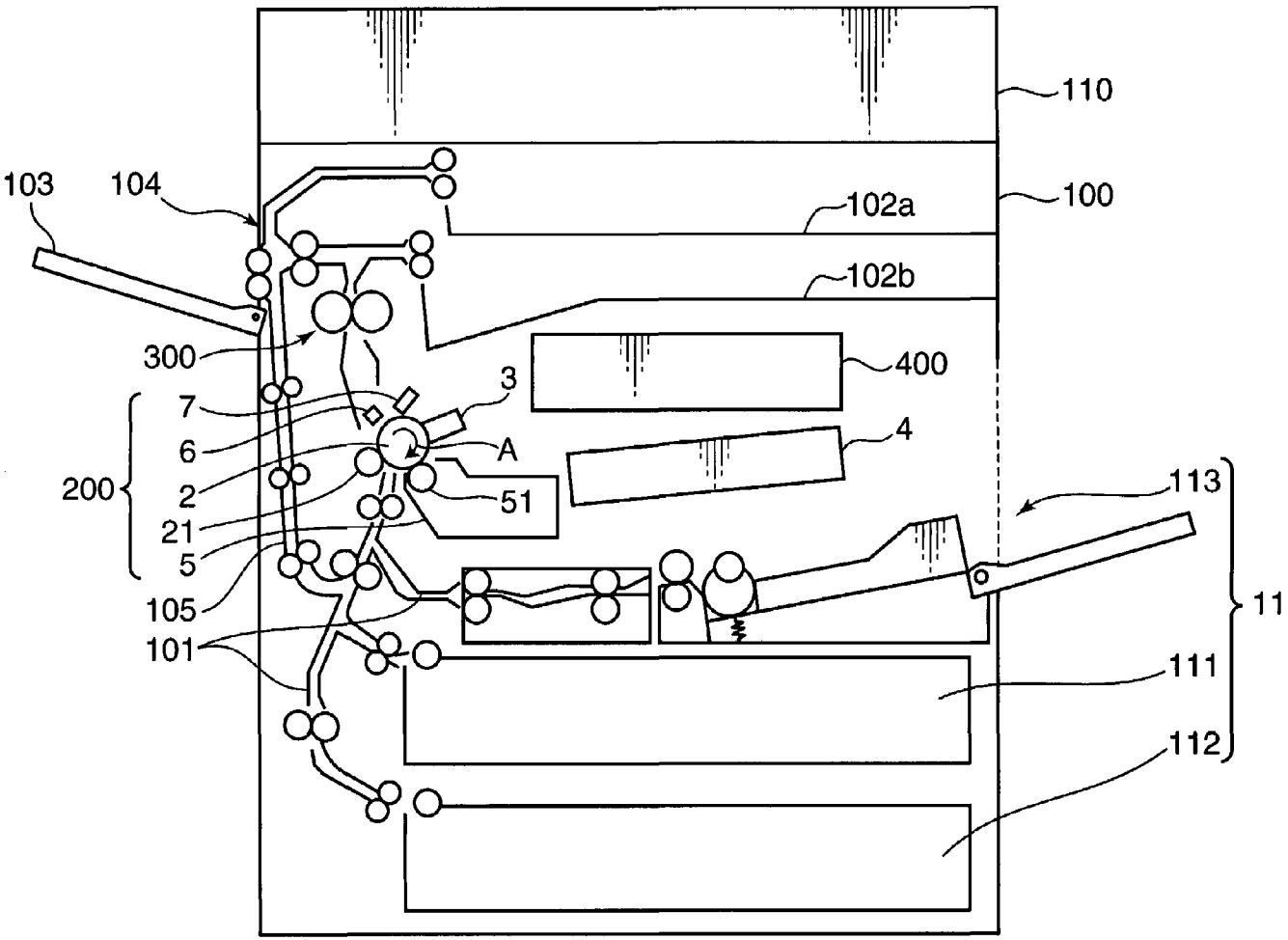
FIG. 1 is an illustration showing an example of a schematic construction of a copying machine, which is an example of an image forming apparatus according to an embodiment of the invention.

An image forming apparatus according to one embodiment of the present invention will now be described with reference to the drawings. FIG. 1 is a schematic diagram generally showing the image forming apparatus according to the embodiment of the present invention. While the following description will be made in connection with one example where the image forming apparatus is a copying machine, it is understood that the image forming apparatus may be of any other type (e.g. a facsimile machine, a printer or a scanner).

As shown in FIG. 1, the copying machine 1 essentially includes a machine main body 100 and a document reading unit 110. The machine main body 100 has a sheet feeding mechanism 11, a sheet transport path 101, an image forming section 200, a fixing section 300, and a toner container 400, as internal components.

The sheet feeding mechanism 11 is detachably attached to the machine main body 100, and includes sheet cassettes 111, 112 for accommodating recording sheets of individual sizes, and a stack bypass i.e. a bypass tray 113 disposed above the sheet cassettes 111, 112. The sheet cassettes 111, 112, and the bypass tray 113 are communicated with the image forming section 200 via the sheet transport path 101.

The image forming section 200 includes: an amorphous silicon photosensitive drum 2, which serves as a photoconductor, and is rotated in the direction of the arrow A in FIG. 1, to transfer a toner image onto a recording sheet for image formation; a contact charging type charging unit 3, which serves as a charger, and is adapted to substantially uniformly charge the surface of the photosensitive drum 2; an exposure unit 4, which is provided with a laser scanning unit, and is adapted to form an electrostatic latent image corresponding to a document image on the surface of the photosensitive drum 2 by emission of a laser beam; a developing unit 5 for developing the electrostatic latent image into a toner image by attracting a developing agent (hereinafter, called as "toner") to the electrostatic latent image by a developing roller 51; a charge removing unit 6, which serves as a charge remover, and is adapted to remove charge residues from the surface of the photosensitive drum 2 after the toner image is transferred onto the recording sheet; and a cleaning blade 7 for removing toner residues from the surface of the photosensitive drum 2 after the transferring operation.

The fixing section 300 includes a pair of fixing rollers for separating the recording sheet carrying the transferred toner image from the surface of the photosensitive drum 2, and for fixing the toner image on the recording sheet. The toner container 400 is adapted to supply the toner to the developing unit 5.

The document reading unit 110 is a so-called scanner for acquiring image data by reading a document image. The document reading unit 110 includes: a contact glass i.e. a platen glass composed of a transparent member such as glass for placing a document thereon; a mirror unit integrally constituted of an exposure lamp, serving as a light source, for emitting light to irradiate a surface of the document, and a mirror for reflecting the light reflected from the document surface; a lens group for focusing the reflected light from the mirror unit; and a CCD image sensor composed of CCDs (charge coupled devices) for acquiring image data by photoelectrically converting a light image obtained by focusing the reflected light by the lens group into an electrical signal.

Also, the copying machine 1 includes a sheet transport path changer 104 for changing the transport direction of the recording sheet after the image fixation in the fixing section 300 with use of a switchback member, a sheet transport path 105 for transporting the recording sheet in double-sided copying, an upper sheet tray 102*a*, a lower sheet tray 102*b*, and a sheet tray 103, each adapted for discharging the recording sheets in a stacked manner.

Figure 2:
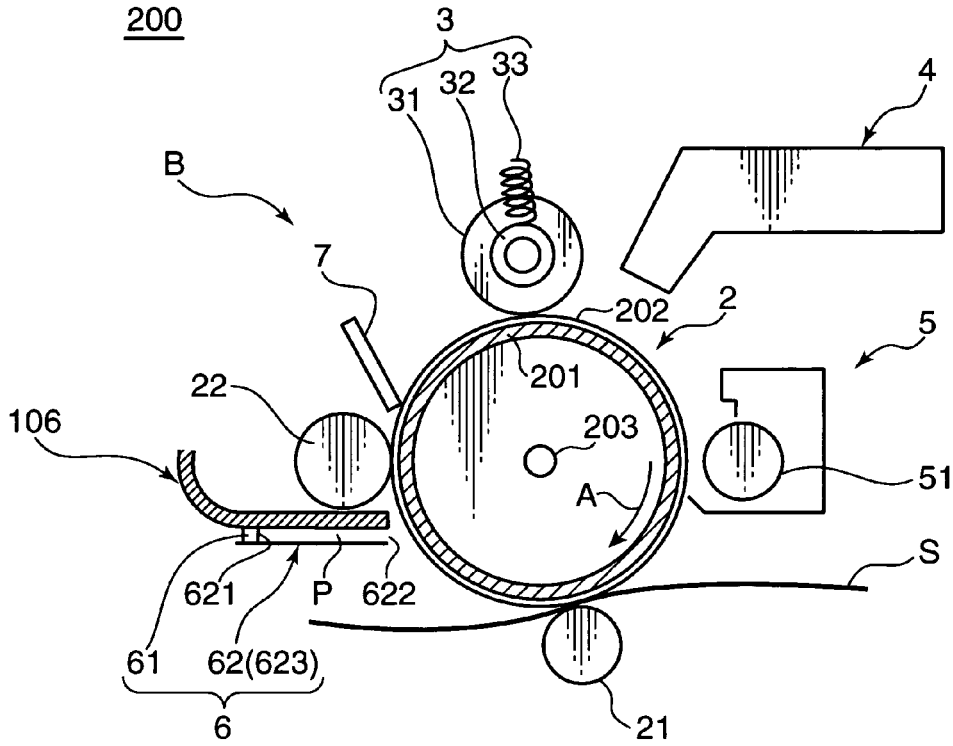
FIG. 2 is an illustration showing an example of a schematic construction of an image forming section in the copying machine shown in FIG. 1.

FIG. 2 is an illustration showing an example of a schematic construction of the image forming section 200. The image forming section 200 for forming an image on a recording sheet S includes, in the periphery of the photosensitive drum 2, the charging unit 3, the exposure unit 4, the developing unit 5, a transfer roller 21, a charge removing unit 6, an abrasion roller 22 (not shown in FIG. 1), and the cleaning blade 7 in this order from upstream in a rotating direction of the photosensitive drum 2 in the direction shown by the arrow A in FIG. 2.

The photosensitive drum 2 is adapted to form an electrostatic latent image on a surface thereof, and includes a cylindrical drum main body 201 made of a metallic material e.g. an aluminum with a diameter of 30 mm, and an amorphous silicon layer 202 having certain photosensitivity. The amorphous silicon layer 202 is formed on the surface of the drum main body 201 by e.g. vapor deposition. The photosensitive drum 2 is rotatably supported about an axis of a rotary shaft 203 at a constant speed e.g. 175 mm/sec.

The amorphous silicon layer 202 is a solidified layer formed by solid-solution of silica (Si) or a silica compound such as SiC, SiO, or SiON. Normally, the amorphous silicon layer 202 is formed by physical vapor deposition such as sputtering. The silicon amorphous layer 202, particularly, a layer made of SiC, has high chargeability owing to its high resistance, and high wear resistance and resistance to environment, which is suitable as a material capable of forming an electrostatic latent image.

The charging unit 3 is adapted to substantially uniformly charge the surface of the photosensitive drum 2 by contact charging. The charging unit 3 includes a charging roller 31 having a cored bar, a conductive layer formed around the cored bar, and a resistive layer formed around the conductive layer. The charging unit 3 also includes: bearings 32 for rotatably supporting the charging roller 31 at opposite ends thereof, respectively; pressure springs 33 for applying an urging force to the bearings 32 disposed at the opposite ends of the charging roller 31, respectively, so that the surface of the charging roller 31 is contacted with the surface of the photosensitive drum 2 with a certain pressing force; and a power source (not shown) for applying, to the charging roller 31, a predetermined voltage e.g. a bias voltage obtained by superimposing an AC voltage to a DC voltage. Specifically, the charging roller 31 is made of a rubber material having conductivity or a foamable synthetic resin so that the charging roller 31 has an elasticity. The charging roller 31 is pressingly contacted with the surface of the rotating photosensitive drum 2, while being applied with a predetermined voltage to increase the surface potential of the photosensitive drum 2.

The exposure unit 4 is disposed downstream of the charging unit 3, and includes an LED printer head arranged opposing to the surface of the photosensitive drum 2. The LED printer head has, for instance, 7,168 pixels arrayed in the direction of the rotational axis of the photosensitive drum 2. The LED printer head emits a laser beam toward the surface of the photosensitive drum 2 to form an electrostatic latent image on the surface of the photosensitive drum 2.

The developing unit 5 is adapted to form a toner image by attracting toner onto the electrostatic latent image formed on the surface of the photosensitive drum 2 by the exposure unit 4. The toner image is formed according to monochromatic or single component jumping.

The transfer roller 21 is adapted to transfer the toner image from the surface of the photosensitive drum 2 i.e. from the amorphous silicon layer 202 to the recording sheet S being transported between the surface of the transfer roller 21 and the surface of the photosensitive drum 2 by applying a polarity different from the polarity of the electric charge of the toner image formed on the surface of the photosensitive drum 2.

The charge removing unit 6 serving as the charge remover is adapted to remove the charge on an area of the surface of the photosensitive drum 2 where the electrostatic latent image has been formed by projecting charge removing light toward the area. The charge removing unit 6 includes the LED array 61, which serves as a linear light source, and is adapted to emit charge removing light, and a light guiding member 62 having a linear-shaped light incident end 621 facing the LED array 61, and a linear-shaped light exit end 622 facing the surface of the photosensitive drum 2 to guide the charge removing light onto the surface of the photosensitive drum 2 linearly in the axial direction thereof. The construction of the charge removing unit 6 will be described later, referring to several examples.

The abrasion roller 22 is made of a synthetic resin having elastic deformability and enhanced durability. The abrasion roller 22 is adapted to clean the amorphous silicon layer 202, which is formed on the surface of the photosensitive drum 2, by abrasion. The abrasion roller 22 is rotated about the rotational axis thereof in a direction opposite to the rotating direction of the photosensitive drum 2 i.e. the counterclockwise direction in FIG. 2 at a circumferential speed higher than the circumferential speed of the photosensitive drum 2. Thereby, discharge products or toner residues on the amorphous silicon layer 202 are rubbed off to clean the amorphous silicon layer 202.

The cleaning blade 7 is a cleaning member for finishing the surface of the photosensitive drum 2. The cleaning blade 7 is made of an elastic material such as rubber, and is formed into a planar shape. The cleaning blade 7 has a downslope toward the surface of the photosensitive drum 2, with a lead end thereof in contact with the amorphous silicon layer 202. In this arrangement, as the photosensitive drum 2 is rotated in the direction of the arrow A in FIG. 2, the residues that could not been removed by the abrasion roller 22 are scraped off by the cleaning blade 7. The residues such as discharge products and toner residues that have been removed by the abrasion roller 22 and the cleaning blade 7 are recovered in an unillustrated recovery bottle provided in the machine main body 100.

Figure 3:
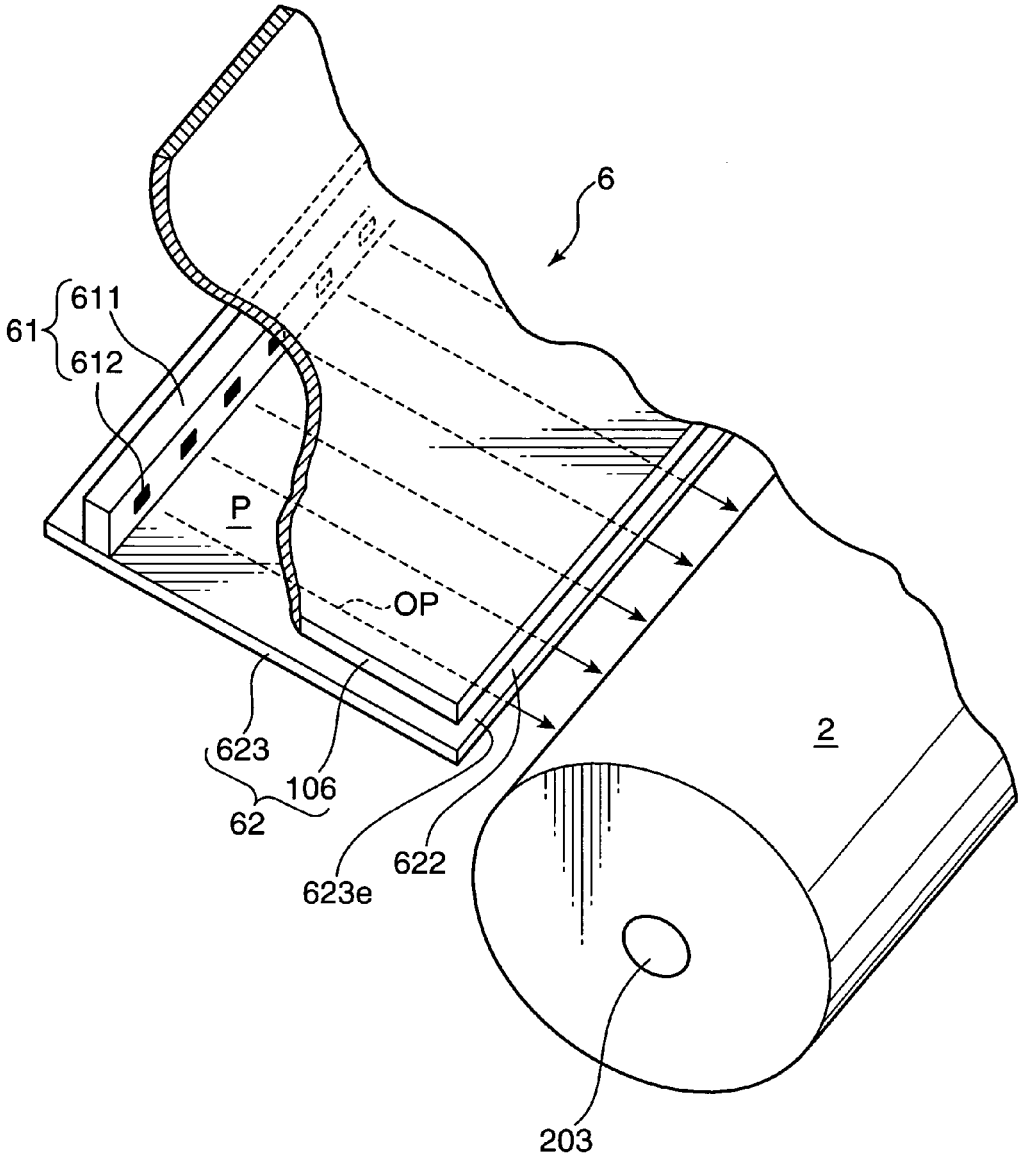
FIG. 3 is a partially cutaway perspective view showing a positional relation between a charge removing unit and a photosensitive drum in the copying machine shown in FIG. 1.

Next, a construction of the charge removing unit 6 is described in detail. FIG. 3 is a partially cutaway perspective view showing a positional relation between the charge removing unit 6 and the photosensitive drum 2. The charge removing unit 6 includes the LED array 61 as the linear light source, and the light guiding member 62. The LED array 61 includes an elongated bar-like LED holder 611, and a certain number of LEDs 612 arrayed on the LED holder 611 at a certain interval. The LED 612 is an end surface emitting type semiconductor light emitter for emitting charge removing light of a certain wavelength having charge removability.

The light guiding member 62 is constituted of a pair of planar members for defining a slit-like light transmitting space P. In the embodiment, the slit-like light transmitting space P is defined in the light emitting direction of the LED array 61 with use of an optical path defining member 623 and a frame member 106. The frame member 106 is a component used for mounting the photosensitive drum 2. The frame member 106 is made of an SUS sheet metal, and is a planar member having a width at least substantially equal to the axial length of the rotary shaft 203 of the photosensitive drum 2. The optical path defining member 623 is constituted of a film member having a certain reflectance. Similarly to the frame member 106, the optical path defining member 623 is a planar member having a width at least substantially equal to the axial length of the rotary shaft 203 of the photosensitive drum 2.

The slit-like light transmitting space P is defined by arranging the LED array 61 within a space defined by the frame member 106 and the optical path defining member 623, which are vertically spaced away from each other. Charge removing light OP emitted from each of the LEDs 612 of the LED array 61 is transmitted through the light transmitting space P and is guided to the vicinity on the surface of the photosensitive drum 2. Then, the guided charge removing light OP through the exit end 622 is linearly projected onto the surface of the photosensitive drum 2 in the axial direction thereof. The projection of the charge removing light OP enables to remove the charge residues from the surface of the photosensitive drum 2 after a transferring operation.

In the copying machine 1 having the above construction, the light guiding member 62 of the charge removing unit 6 has a function of controlling the amount of the charge removing light to be projected onto the surface of the photosensitive drum 2 in the direction of the rotational axis of the photosensitive drum 2, in other words, charge removing light amount controlling means. In the following, several examples of the arrangement on the charge removing light amount controlling means of the light guiding member 62 of the charge removing unit 6 for controlling the charge removing light amount will be described in details.

Figure 4:
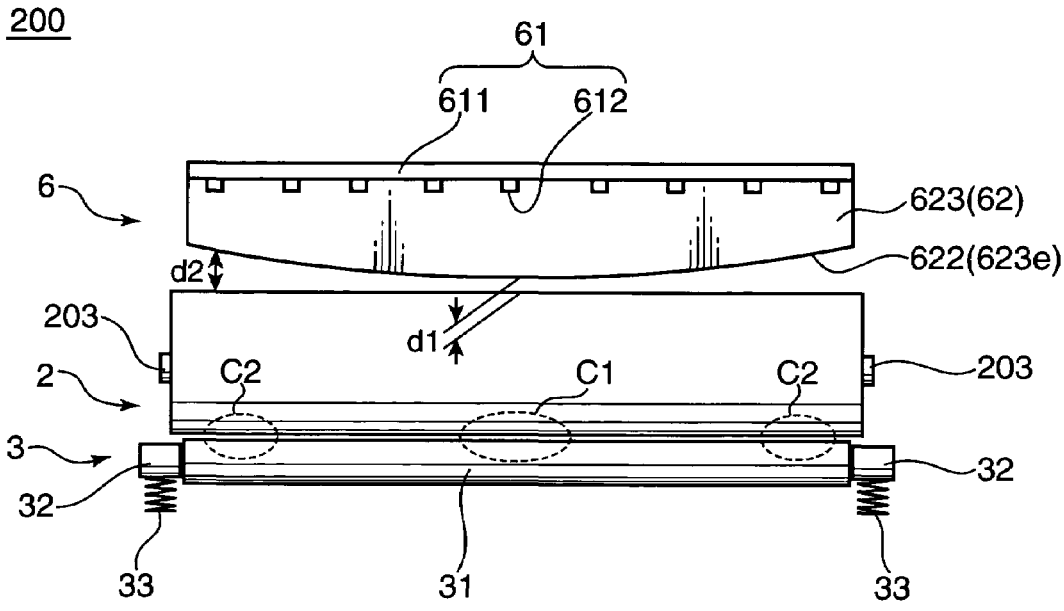
FIG. 4 is a plan view of a construction of the charge removing unit in accordance with a first embodiment of the invention, viewed from the direction of the arrow B in FIG. 2.

The first embodiment is directed to an arrangement, which is designed to suppress a surface potential distribution non-uniformity due to a nip distance difference between the charging roller 31 and the photosensitive drum 2. FIG. 4 is a plan view showing an arrangement of the charge removing unit 6 in the first embodiment. Specifically, FIG. 4 is a plan view of the charge removing unit 6 viewed from the direction of the arrow B in FIG. 2, showing the components of the charge removing unit 6 except for the frame member 106. In the first embodiment, the distance between the exit end 622 of the light guiding member 62 and a surface of an axially central part of the photosensitive drum 2 (hereinafter, also called as "axially central part of the photosensitive drum 2") is set to a first distance, and the distance between the exit end 622 and a surface of axially opposite ends of the photosensitive drum 2 (hereinafter, also called as "axially opposite ends of the photosensitive drum 2") is set to a second distance, wherein the second distance is longer than the first distance. With this arrangement, an mount of the charge removing light to be projected onto the surface of the photosensitive drum 2 can be varied between the axially central part and the axially opposite ends of the photosensitive drum 2.

As shown in FIG. 4, an end surface 623*e* of the optical path defining member 623 is curved in the axial direction of the rotary shaft 203 of the photosensitive drum 2. Specifically, the optical path defining member 623 is configured in such a manner that the distance between the end surface 623*e* corresponding to the axially central part of the photosensitive drum 2, and the axially central part of the photosensitive drum 2 is defined as the first distance d1 having a relatively short distance, and that the distance between the end surface 623*e* corresponding to the axially opposite ends of the photosensitive drum 2, and the axially opposite ends of the photosensitive drum 2 is defined as the second distance d2 having a relatively long distance. In other words, the end surface 623*e* is so shaped that the distance between the end surface 623*e* and the surface of the photosensitive drum 2 is gradually increased toward the axially opposite ends of the photosensitive drum 2, with the first distance d1 between the end surface 623*e* and the axially central part of the photosensitive drum 2 being shortest. With this arrangement, an irradiation width on the surface of the photosensitive drum 2 by projection of the charge removing light OP can be varied between the axially central part and the axially opposite ends of the photosensitive drum 2, as shown in FIGS. 5A and 5B.

Figure 5A:
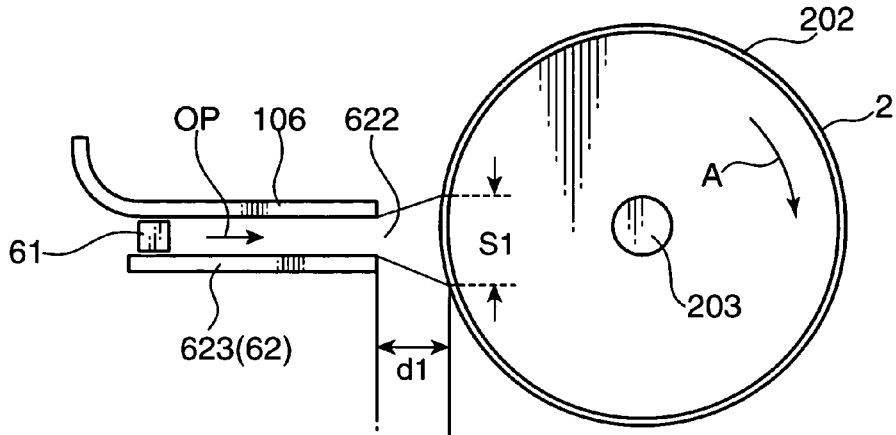
FIGS. 5A and 5B are side views for briefly describing a relation between a distance between an end portion of an optical path defining member and a surface of the photosensitive drum, and an irradiation width of charge removing light in the first embodiment.
Figure 5B:
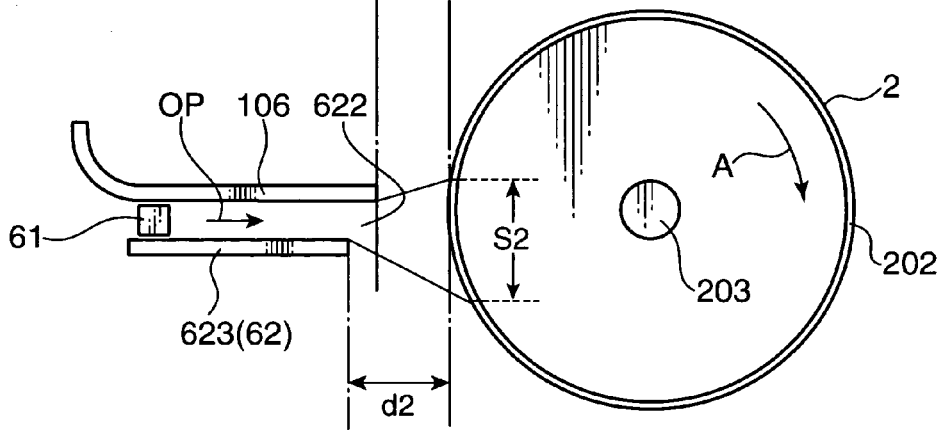

Specifically, as shown in FIG. 5A, in the case where the distance between the end surface 623*e* of the optical path defining member 623 and the surface of the photosensitive drum 2 is set to the first distance d1, diffusivity of the charge removing light OP is relatively small due to the relatively short distance. As a result, the surface of the photosensitive drum 2 is projected with the charge removing light OP with a relatively narrow irradiation width i.e. a first irradiation width S1. On the other hand, as shown in FIG. 5B, in the case where the distance between the end surface 623*e* of the optical path defining member 623 and the surface of the photosensitive drum 2 is set to the second distance d2, diffusivity of the charge removing light OP is relatively large due to the relatively long distance. As a result, the surface of the photosensitive drum 2 is projected with the charge removing light OP with a relatively wide irradiation width i.e. a second irradiation width S2.

In this way, the amount of the charge removing light OP to be projected onto the amorphous silicon layer 202 of the photosensitive drum 2 can be varied between the axially central part and the axially opposite ends of the photosensitive drum 2 by varying the irradiation width of the charge removing light OP between the axially central part and the axially opposite ends of the photosensitive drum 2, as mentioned above. In other words, in the case where the irradiation width is set to the first irradiation width S1, which is a relatively narrow width, a time for irradiating the surface of the photosensitive drum 2 with the charge removing light OP is short because the irradiation width is relatively narrow, assuming that the charge removing light OP is projected onto an arbitrary point on the surface of the photosensitive drum 2 which is rotated at a certain circumferential speed. As a result, the amount of the charge removing light OP to be projected from the charge removing unit 6 is relatively small. On the other hand, in the case where the irradiation width is set to the second irradiation width S2, which is a relatively wide width, a time for irradiating the surface of the photosensitive drum 2 with the charge removing light OP is long because the irradiation width is relatively wide. As a result, the amount of the charge removing light OP to be projected from the charge removing unit 6 is relatively large.

The amorphous silicon photoconductor has a characteristic that the generated amount of excited light carriers is varied depending on the amount of the charge removing light to be projected from the charge removing unit 6 for charge removal. In other words, the more the amount of the charge removing light is, the more the generated amount of light carriers is. Also, the light carriers are likely to be trapped in the amorphous silicon layer 202, as the amount of the charge removing light is increased. The trapped light carriers may cause neutralization of electrical charge applied from the charging roller 31 in a charging operation, which may lower the surface potential of the photosensitive drum 2. This means that the charging potential in the charging operation can be controlled by controlling the amount of the charge removing light to be projected onto the amorphous silicon layer 202.

As mentioned above, the amorphous silicon photoconductor has the characteristic that the generated amount of light carriers is increased as the amount of the charge removing light is increased. Accordingly, the generated amount of light carriers at a region on the amorphous silicon layer 202 corresponding to the axially central part of the photosensitive drum 2 shown in FIG. 5A is made relatively small because the charge removing light of a relatively small amount is projected onto the axially central part of the photosensitive drum 2. On the other hand, the generated amount of light carriers at a region on the amorphous silicon layer 202 corresponding to the axially opposite ends of the photosensitive drum 2 shown in FIG. 5B is made relatively large because the charge removing light of a relatively large amount is projected onto the axially opposite ends of the photosensitive drum 2.

The above arrangement is employed in the first embodiment for the following reason. As shown in FIG. 4, in the image forming apparatus provided with the contact charging type charging roller 31 or the like, in order to bring the charging roller 31 into pressing contact with the photosensitive drum 2, it is required to provide the pressure springs 33 for urging the bearings 32 at the opposite ends of the charging roller 31 in view of likelihood that a sufficient pressing force may not be secured for the roller main body. Providing urging members such as the pressure springs 33, however, may result in a smaller load to be exerted to the axially central part of the photosensitive drum 2, as compared with the axially opposite ends thereof. As a result, the nip width between the photosensitive drum 2 and the charging roller 31 may be narrow on an axially central part C1, as compared with axially opposite ends C2. This may lower the surface potential i.e. the charging potential on the axially central part C1, as compared with the axially opposite ends C2.

Figure 6:
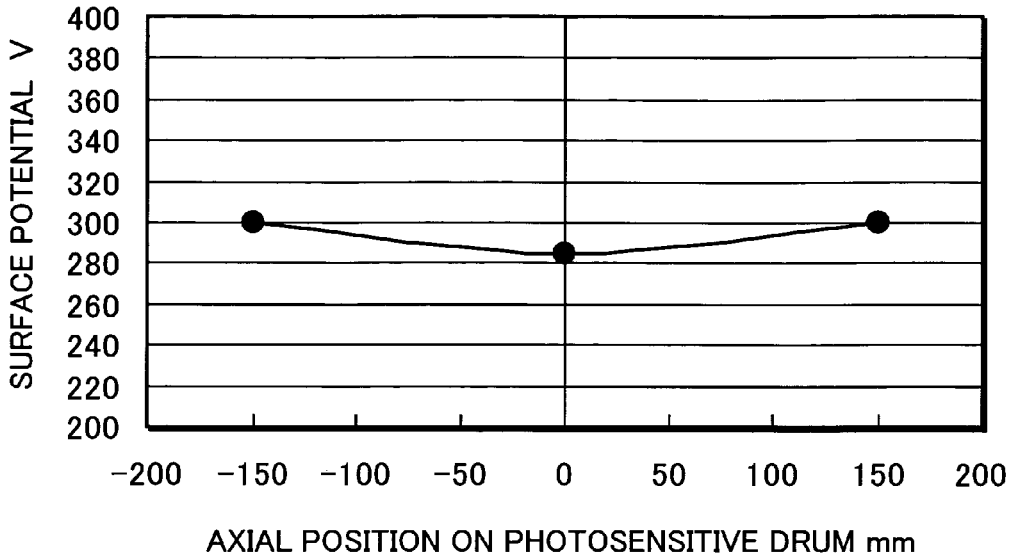
FIG. 6 is a graph showing a surface potential distribution in an axial direction of the photosensitive drum in the case where the photosensitive drum is charged by a charging roller.

FIG. 6 is a graph showing an example of a surface potential distribution in the case where the photosensitive drum 2 is charged in a state that the charging roller 31 applied with a pressing force at the opposite ends thereof is in pressing contact with the photosensitive drum 2 having an axial length of about 300 mm. As is obvious from FIG. 6, the surface potential of the photosensitive drum 2 at the axially central part i.e. a point in axial direction=0 mm is lower than that at the axially opposite ends by about 15V. Such a surface potential difference may lead to a drawback such as so-called fog in image formation. It is possible to reduce the nip distance difference between the photosensitive drum and the charging roller to some extent by raising the rigidity of the cored bar of the charging roller 31, or by using a conductive rubber layer having a small hardness. Such measures, however, cannot completely eliminate the nip distance difference, which may likely to cause a surface potential distribution non-uniformity in use of the photosensitive drum 2 i.e. an amorphous silicon photoconductor having low chargeability.

In light of the above drawback, in the first embodiment, the distance between the end surface 623*e* of the optical path defining member 623 and the surface of the photosensitive drum 2 is set in such a manner that the first distance d1, which is shorter than the second distance d2, is set for the axially central part of the photosensitive drum 2 to secure the first irradiation width S1, and that the second distance d2, which is longer than the first distance d1, is set for the axially opposite ends of the photosensitive drum 2 to secure the second irradiation width S2. Also, the distance is gradually increased as the end surface 623*e* extends from the axially central part of the photosensitive drum 2 toward the axially opposite ends thereof, which makes it possible to control the generated amount of light carriers in the axial direction of the photosensitive drum 2, thereby eliminating occurrence of a surface potential distribution non-uniformity.

Figure 7:
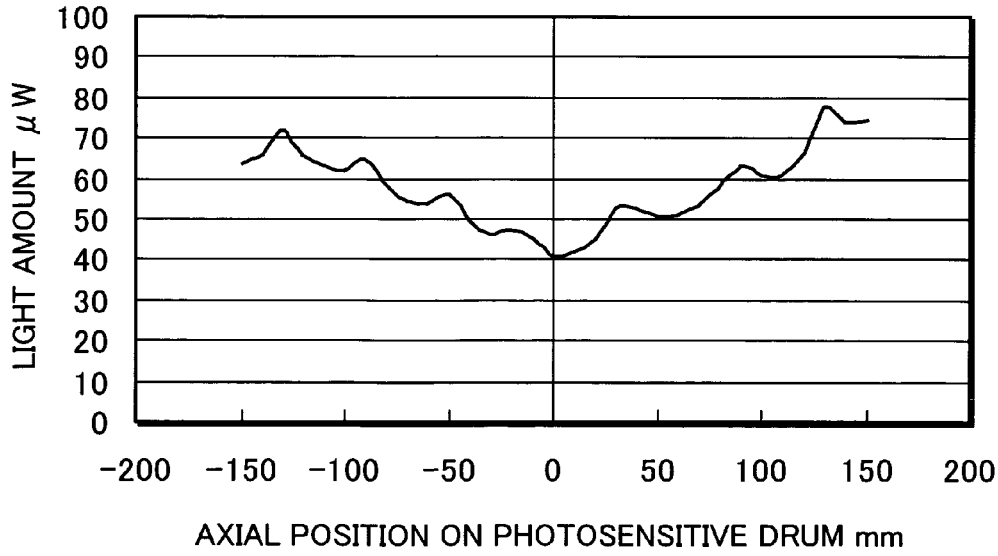
FIG. 7 is a graph showing a light amount distribution of charge removing light to be projected onto the surface of the photosensitive drum in the axial direction thereof in the case where the first embodiment or a second embodiment of the invention is applied.

In other words, as shown in FIG. 7, the amount of the charge removing light is reduced on the axially central part of the photosensitive drum 2 whose surface potential is lowered in the case where the photosensitive drum 2 is charged by the charging roller 31 by contact charging. With this arrangement, since the light amount for charge removal is decreased, the generated amount of light carriers is reduced, thereby suppressing neutralization of electrical charge in a charging operation. On the other hand, a relatively large amount of the charge removing light is projected onto the axially opposite ends of the photosensitive drum 2. This arrangement allows generation of light carriers of a relatively large amount, thereby allowing a certain degree of lowering of the surface potential due to neutralization of electrical charge in the charging operation.

Figure 8:
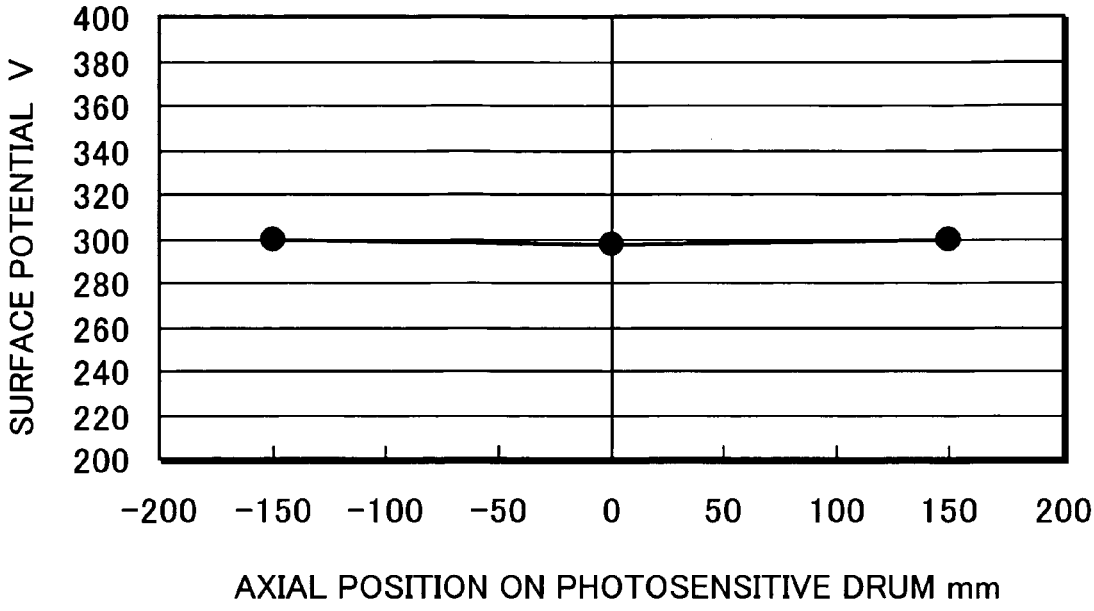
FIG. 8 is a graph showing a surface potential distribution in the axial direction of the photosensitive drum in the case where the photosensitive drum is charged by the charging roller in the first embodiment or in the second embodiment of the invention.

In this way, charging the photosensitive drum 2 by the charging roller 31 of the charging unit 3 in a state that the generated amount of light carriers in the amorphous silicon layer 202 of the photosensitive drum 2 is varied in the axial direction of the photosensitive drum 2 with use of the charge removing unit 6 enables to increase the charging potential on the axially central part of the photosensitive drum 2, as compared with the axially opposite ends thereof because the generated amount of light carriers is reduced on the axially central part, as compared with the axially opposite ends. This arrangement enables to eliminate occurrence of a surface potential distribution non-uniformity due to a nip distance difference between the photosensitive drum 2 and the charging roller 31 in the axial direction of the photosensitive drum 2, thereby securing a uniform surface potential distribution. FIG. 8 is a graph showing a surface potential distribution in the axial direction of the photosensitive drum 2 after a charging operation in contact with the charging roller 31 in the embodiment. As is obvious from FIG. 8, the surface potential distribution of the photosensitive drum 2 in the axial direction thereof is flat, in other words, the photosensitive drum 2 is free from a surface potential distribution non-uniformity.

The charge removing unit 6 in the first embodiment is advantageous in eliminating occurrence of a surface potential distribution non-uniformity due to a nip distance difference between the charging roller 31 and the photosensitive drum 2, namely, a phenomenon that the surface potential is lowered on the axially central part of the photosensitive drum 2, as compared with the axially opposite ends thereof in charging the photosensitive drum 2 by the contact charging type charging roller 31, by controlling the generated amount of light carriers in the axial direction of the photosensitive drum 2. This enables to eliminate occurrence of an image formation failure such as fog resulting from a surface potential distribution non-uniformity in a contact charging type image forming apparatus with use of an amorphous silicon photoconductor.

The first embodiment may be modified as follows.

In the first embodiment, the frame member 106 and the optical path defining member 623, which constitute the light guiding member 62, define the slit-like light transmitting space P. Alternatively, the light transmitting space P may be defined by using various planar members in place of using the frame member 106 and the optical path defining member 623. In the modification, however, it is desirable to apply a light reflective coat on a surface of the planar members to prevent absorption of the charge removing light. Use of the frame member 106 in the machine main body 100 as described in the embodiment is preferable to keep the number of the components constituting the image forming apparatus from increasing.

In place of defining the slit-like light transmitting space P as in the first embodiment, it is possible to use, for instance, a light guiding film, a light guiding plate, or a like member having a light guiding characteristic by itself, to oppose an incident end of the light guiding film or the light guiding plate to the LED array 61, and to oppose an exit end thereof to the surface of the photosensitive drum 2. In the modification, the irradiation width on the surface of the photosensitive drum 2 by the charge removing light can be controlled by forming a surface of the exit end of the light guiding film or the light guiding plate into a curved shape as shown in FIG. 4.

In the first embodiment, the distance between the end surface 623*e* of the optical path defining member 623 and the surface of the photosensitive drum 2 is gradually increased as the end surface 623*e* extends from the axially central part of the photosensitive drum 2 toward the axially opposite ends thereof. Alternatively, the end surface 623*e* may have such stepped portions that the distance between the end surface 623*e* of the optical path defining member 623 and the surface of the photosensitive drum 2 is gradually increased stepwise, as the end surface 623*e* extends from the axially central part of the photosensitive drum 2 toward the axially opposite ends thereof.

In the first embodiment, the distance between the end surface 623*e* of the optical path defining member 623 and the surface of the photosensitive drum 2 is axially varied to vary the irradiation width on the surface of the photosensitive drum 2 by the charge removing light. Alternatively, the irradiation width by the charge removing light may be varied by varying the width of the slit of the light transmitting space P between the axially central part of the photosensitive drum 2 and the axially opposite ends thereof. Specifically, the distance between the frame member 106 and the optical path defining member 623 at the exit end 622 of the light guiding member 62 is set relatively small at the axially central part of the photosensitive drum 2, and the distance between the frame member 106 and the optical path defining member 623 at the exit end 622 of the light guiding member 62 is set relatively large at the axially opposite ends of the photosensitive drum 2. The modification enables to secure a relatively large amount of the charge removing light to be projected onto the surface of the photosensitive drum 2 at the axially opposite ends of the photosensitive drum 2.

Figure 9:
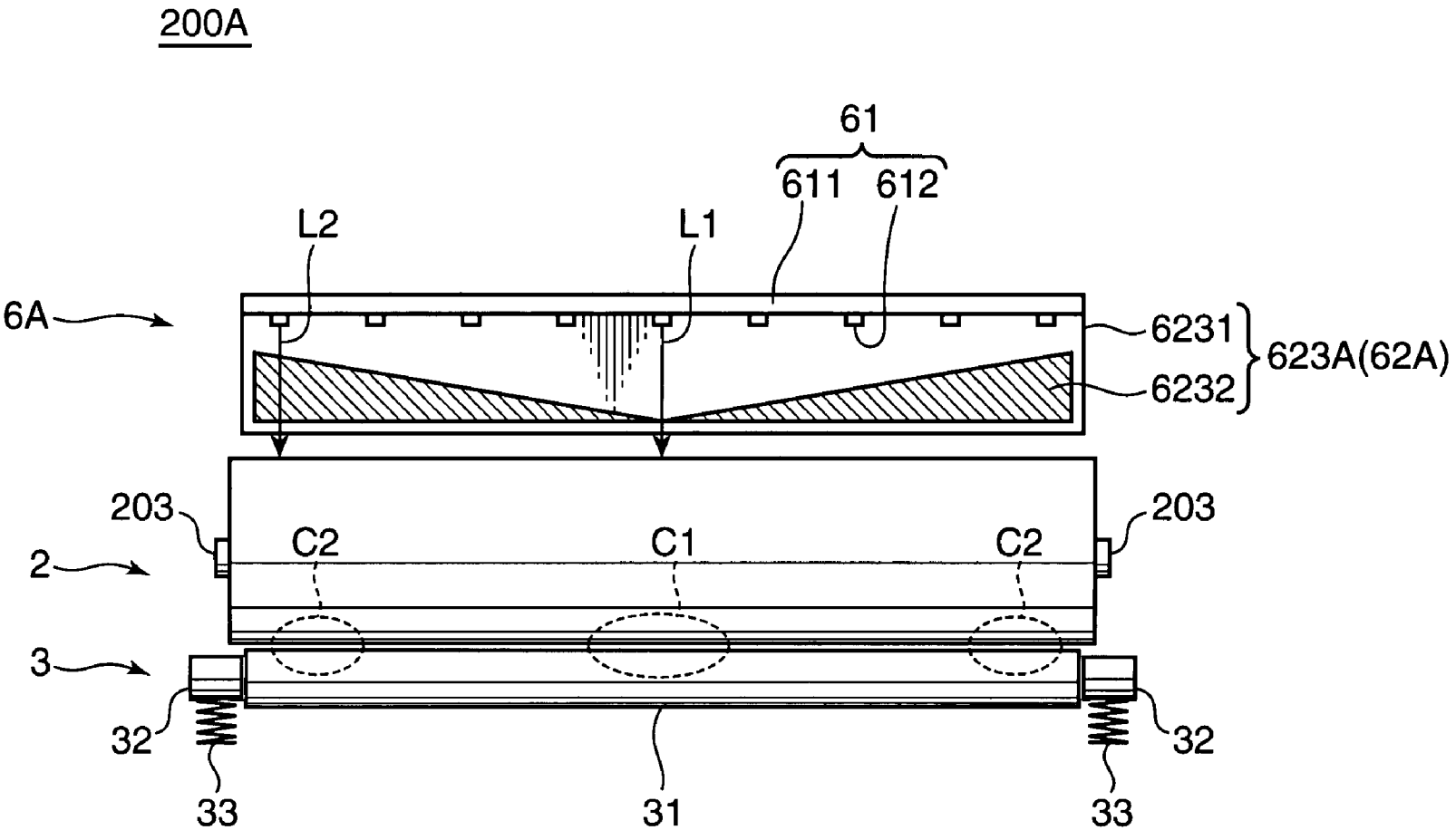
FIG. 9 is a plan view showing a construction of a charge removing unit in the second embodiment, viewed from the direction of the arrow B in FIG. 2.

Similarly to the first embodiment, a second embodiment is designed to suppress a surface potential distribution non-uniformity due to a nip distance difference between a charging roller and a photosensitive drum. FIG. 9 is a plan view showing an arrangement of a charge removing unit 6A in accordance with the second embodiment. FIG. 9 is a plan view of the charge removing unit 6A viewed from the direction of the arrow B in FIG. 2. Similarly to the illustration of FIG. 4, FIG. 9 shows an arrangement of the charge removing unit 6A except for a frame member 106. In the embodiment, a light guiding member 62A is used to allow a relatively large amount of charge removing light to be projected onto axially opposite ends of the photosensitive drum 2, as compared with an axially central part thereof. Specifically, the light guiding member 62A is constructed in such a manner that charge removing light to be projected onto the surface of the axially central part of the photosensitive drum 2 is transmitted with a first light guiding characteristic, and that charge removing light to be projected onto the surface of the axially opposite ends of the photosensitive drum 2 is transmitted with a second light guiding characteristic, wherein the second light guiding characteristic has a light transmittance loss smaller than that of the first light guiding characteristic.

In the charge removing unit 6A in the second embodiment, a surface of a frame member 106, which is a component for defining a slit-like light transmitting space P of the light guiding member 62A, facing the light transmitting space P, has a substantially uniform reflectance to the charge removing light. On the other hand, a surface of an optical path defining member 623A facing the light transmitting space P has a locally varied reflectance to the charge removing light in order to vary the amount of the chare removing light to be projected onto the surface of the photosensitive drum 2 in the axial direction of the photosensitive drum 2.

As shown in FIG. 9, the optical path defining member 623A is produced by placing a first reflective member 6231 having a relatively low reflectance e.g. 50% or less in reflectance to the charge removing light, as a base member, and by attaching, on the base member, a second reflective member 6232 having a relatively high reflectance e.g. 85% or more in reflectance to the charge removing light, on the side facing the light transmitting space P. An example of the optical path defining member 623A is produced by using a black matte film having a reflectance of 38% to charge removing light having a wavelength of 660 nm, as the first reflective member, and by using a silver aluminum tape having a reflectance of 95% to the charge removing light having a wavelength of 660 nm, as the second reflective member 6232.

Figure 10A:
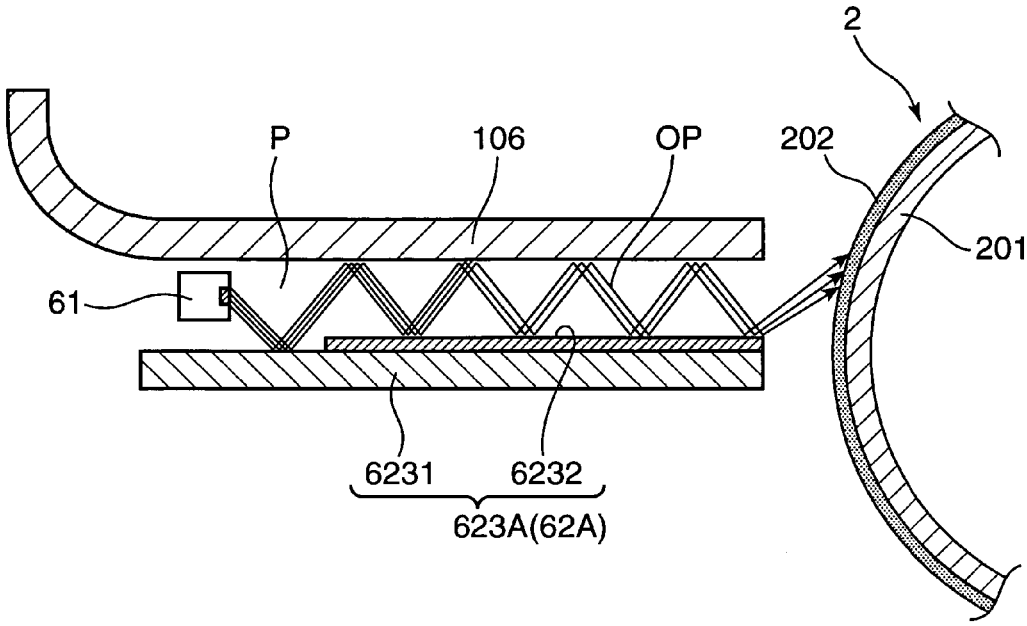
Figure 10B:
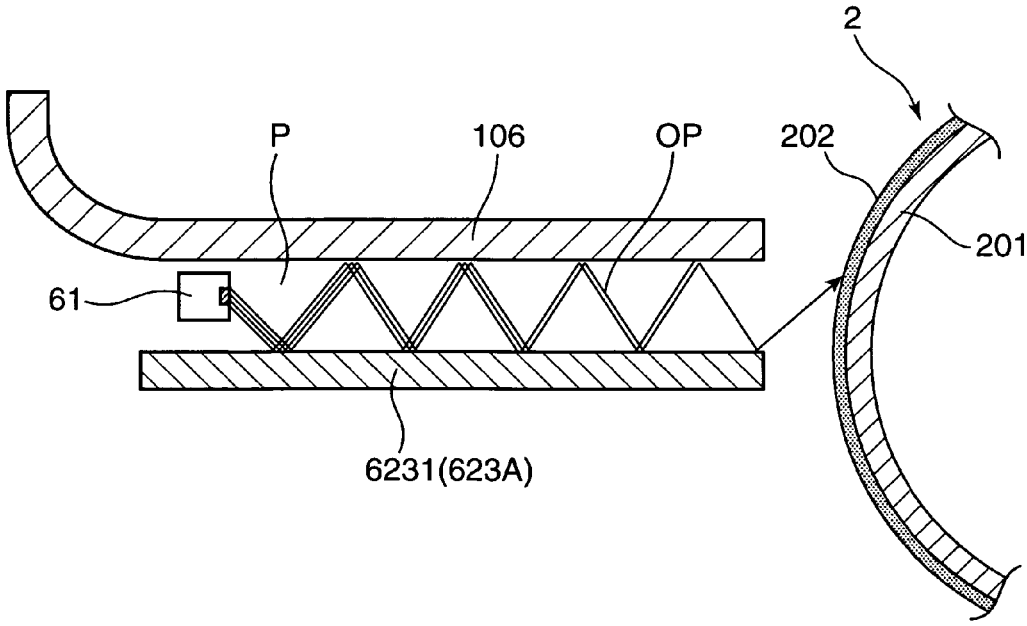

The second reflective member 6232 has a shape of a right-angled triangle in cross-section having a largest width at a position corresponding to the axially opposite ends of the photosensitive drum 2 i.e. end parts in the rotational axis thereof, and a smallest width at a position corresponding to the axially central part of the photosensitive drum 2 i.e. a central part in the rotational axis thereof. Specifically, as shown in FIG. 10A, within the light transmitting space P of the optical path defining member 623A, the high-reflectance second reflective member 6232 is designed in such a manner that: the area of the second reflective member 6232 at the axially opposite ends of the photosensitive drum 2 becomes the largest; the area is gradually reduced toward the axially central part of the photosensitive drum 2; and that the area becomes the smallest at the axially central part of the photosensitive drum 2, in other words, the area is solely constituted of the low reflectance first reflective member 6231, as shown in FIG. 10B.

With the optical path defining member 623A, as shown in FIG. 9, the light guiding characteristics of the charge removing light can be varied between a first shortest line L1 connecting the vicinity of the longitudinal central part of an LED array 61 and the vicinity of the axially central part of the photosensitive drum 2, and a second shortest line L2 connecting the longitudinal opposite ends of the LED array 61 and the axially opposite ends of the photosensitive drum 2. In other words, the surface of the optical path defining member 623A facing the light transmitting space P has a first reflectance on the first shortest line L1 where the ratio of the low-reflectance first reflective member 6231 to the high-reflectance second reflective member 6232 is the largest, and a second reflectance on the second shortest line L2 where the ratio of the high-reflectance second reflective member 6232 to the low-reflectance first reflective member 6231 is the largest.

With the above arrangement, the light guiding member 62A exhibits a light guiding characteristic from an incident end 621 toward an exit end 622 as mentioned below. The first light guiding characteristic having a relatively large light transmittance loss of the charge removing light is secured on the first shortest line L1, and the second light guiding characteristic having a relatively small light transmittance loss of the charge removing light is secured on the second shortest line L2 (see FIGS. 10A and 10B). As a result of this arrangement, the amount of the charge removing light to be projected onto the axially central part of the photosensitive drum 2 is set small, as compared with the axially opposite ends thereof.

As mentioned above, the amorphous silicon photoconductor has the characteristic that the generated amount of light carries is increased as the amount of the charge removing light is increased. Accordingly, the generated amount of light carriers in an amorphous silicon layer 202 of the photosensitive drum 2 is set relatively small on the axially central part of the photosensitive drum 2 on the first shortest line L1. On the other hand, a relatively large amount of the charge removing light is projected onto the axially opposite ends of the photosensitive drum 2 on the second shortest line L2, which enables to increase the generated amount of light carries in the amorphous silicon layer 202. Accordingly, the second embodiment enables to provide substantially the same operations and effects as the first embodiment, which has been described referring to FIGS. 6 through 8.

Specifically, as shown in FIG. 9, the charge removing light to be projected onto an axially central part C1, where the surface potential is lowered in the case where the photosensitive drum 2 is charged by the contact charging type charging roller 31, is reduced to suppress the generated amount of light carriers, thereby suppressing excessive neutralization of electric charge in a charging operation. On the other hand, a relatively large amount of the charge removing light is allowed to be projected onto an axially central part C2 to increase the generated amount of light carriers, thereby allowing a certain degree of lowering of the surface potential due to neutralization of electric charge in a charging operation. In this way, the charge removing unit 6A is constructed in such a manner that the generated amount of light carriers in the amorphous silicon layer 202 of the photosensitive drum 2 is varied in the axial direction of the photosensitive drum 2, and that the photosensitive drum 2 is charged by the charging roller 31 of a charging unit 2 with use of the charge removing unit 6A. This enables to increase the charging potential on the axially central part of the photosensitive drum 2, as compared with the axially opposite ends thereof, because the generated amount of light carriers in the amorphous silicon layer 202 is set small on the axially central part of the photosensitive drum 2, as compared with the axially opposite ends thereof. Accordingly, this arrangement enables to eliminate occurrence of a surface potential distribution non-uniformity due to a nip distance difference in the axially direction of the photosensitive drum 2 between the photosensitive drum 2 and the charging roller 31.

The second embodiment may be modified as follows.

In the second embodiment, the light transmittance loss of the charge removing light is made larger on the axially central part of the photosensitive drum 2, as compared with the axially opposite ends thereof by constituting the optical path defining member 623A by combination of the low-reflectance first reflective member 6231 and the high-reflectance second reflective member 6232. Alternatively, various approaches are available for varying the light guiding characteristic between the axially central part and the axially opposite ends of the photosensitive drum 2. For instance, an optical component for increasing the light transmittance loss of the charge removing light may be disposed at a position in the slit-like light transmitting space P corresponding to the axially central part of the photosensitive drum 2.

In place of defining the slit-like light transmitting space P as in the second embodiment, it is possible to use a light guiding film, a light guiding plate, or a like member having a light guiding characteristic by itself, to oppose an incident end of the light guiding film or the light guiding plate to the LED array 61, and to oppose an exit end thereof to the surface of the photosensitive drum 2. In the modification, for instance, light absorptive particles or an equivalent element may be dispersively applied on the light guiding film or the light guiding plate at a portion corresponding to a light transmitting path in order to increase the light transmittance loss of the charge removing light to be projected onto the axially central part of the photosensitive drum 2.

In the second embodiment, the optical path defining member 623A is so constructed as to gradually vary the light guiding characteristic thereof from the axially opposite ends of the photosensitive drum 2 toward the axially central part thereof. Alternatively, the light guiding characteristic of the optical path defining member 623A may be varied stepwise from the axially opposite ends of the photosensitive drum 2 toward the axially central part thereof.

In the second embodiment, the black matte film having a reflectance of 38% to the charge removing light of a wavelength of 660 nm is used as the first reflective member 6231, and the silver aluminum tape having a reflectance of 95% to the charge removing light of the wavelength of 660 nm is used as the second reflective member 6232. Alternatively, various low-reflectance reflective material or a high-reflectance reflective material may be used for the first reflective member 6231 and the second reflective member 6232. For instance, in place of the silver aluminum tape, a composite tape formed by attaching a PET film on both surfaces of a silver film may be used. It is desirable to use a material having a smallest wavelength dependency of reflectance. If a material having a wavelength dependency of reflectance is used, it is preferable to use a material capable of securing a reflectance to light in a wavelength band of about 500 nm to about 700 nm.

Figure 11:
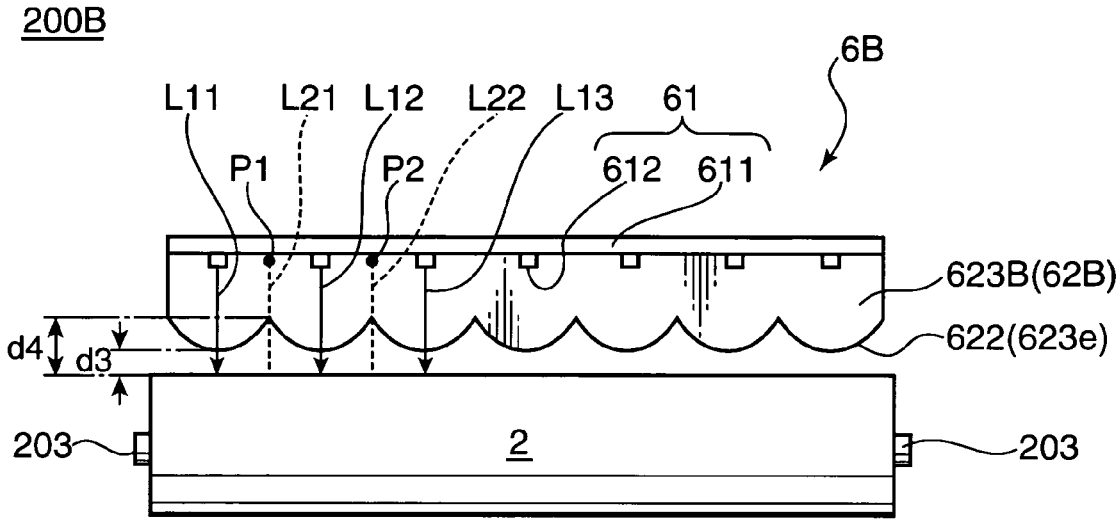
FIG. 11 is a plan view showing a construction of a charge removing unit in a third embodiment of the invention, viewed from the direction of the arrow B in FIG. 2.

The third embodiment is different from the first and the second embodiments in the point that the third embodiment is directed to an arrangement, which is designed to suppress a light amount distribution non-uniformity in the axial direction of a photosensitive drum. FIG. 11 is a plan view showing an arrangement of a charge removing unit 6B in accordance with the third embodiment. FIG. 11 is a plan view of the charge removing unit 6B viewed from the direction of the arrow B in FIG. 2. Similarly to the illustration of FIG. 4, FIG. 11 shows an arrangement of the charge removing unit 6B except for a frame member 106. In the third embodiment, the distance between an exit end 622 of a light guiding member 62B and a surface of the photosensitive drum 2 on a first shortest line connecting each one of LEDs 612 and the surface of the photosensitive drum 2 is set to a first distance, and the distance between the exit end 622 of the light guiding member 62B and the surface of the photosensitive drum 2 on a second shortest line connecting each midpoint between the adjacent LEDs 612 and the surface of the photosensitive drum 2 is set to a second distance, which is longer than the first distance, to vary an irradiation width of the charge removing light to be projected onto the surface of the photosensitive drum 2 i.e. an irradiation time of the charge removing light between a position on the surface of the photosensitive drum 2 on the first shortest line and a position on the surface of the photosensitive drum 2 on the second shortest line.

As shown in FIG. 11, an end surface 623*e* of an optical path defining member 623B is shaped into a wave-like configuration or a scalloped configuration in the axial direction of a rotary shaft 203 of the photosensitive drum 2. Specifically, the end surface 623*e* has such a shape that the distances between the end surface 623*e* at positions of the respective LEDs 612, and the surface of the photosensitive drum 2 on the first shortest lines L11, L12, L13, . . . are set to a first distance d3, and the distances between the end surface 623*e* at positions of midpoints P1, P2, . . . of the adjacent LEDs 612, and the surface of the photosensitive drum 2 on the second shortest lines L21, L22, . . . are set to a second distance d4, which is longer than the first distance d3. In other words, the end surface 623*e* has the wave-like configuration that the distance between the end surface 623*e* and the surface of the photosensitive drum 2 is gradually varied between the first distance d3, which is the shortest distance on the first shortest lines L11, L12, L13 . . . , and the second distance d4, which is the longest distance on the second shortest lines L22, L23, . . . .

Figure 12A:
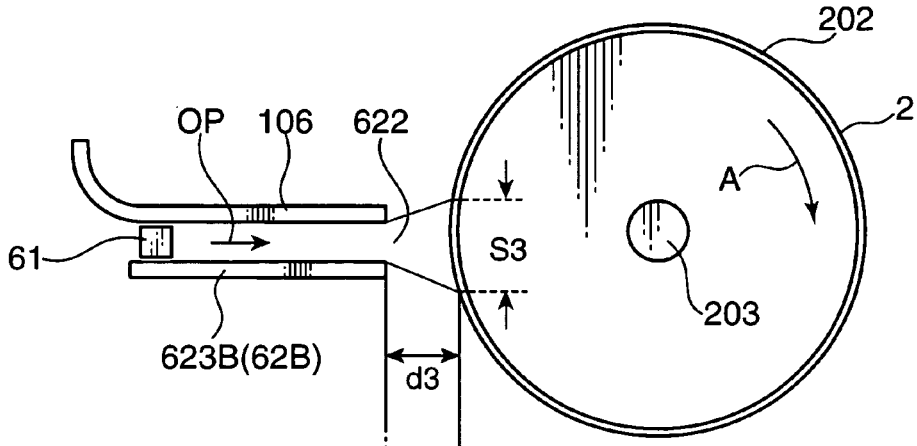
FIGS. 12A and 12B are side views for briefly describing a relation between a distance between an end portion of an optical path defining member and a surface of a photosensitive drum, and an irradiation width of charge removing light in the third embodiment.
Figure 12B:
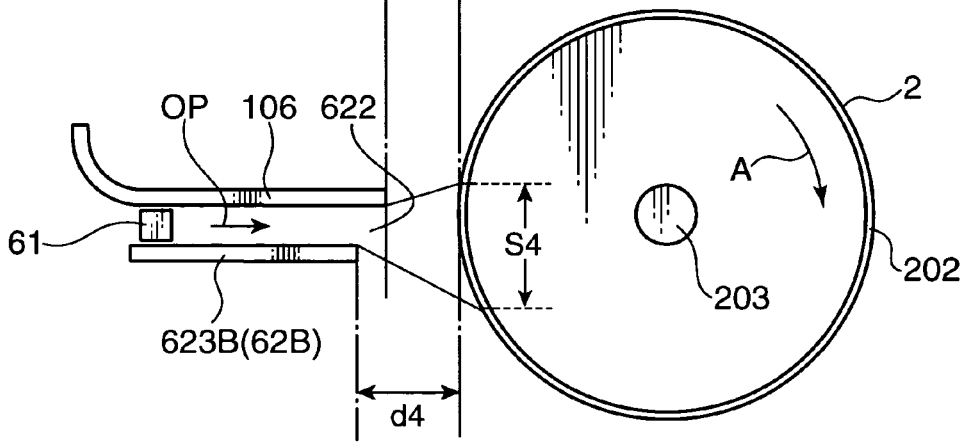

Since the end surface 623*e* of the optical path defining member 623B has the wave-like configuration, as shown in FIGS. 12A and 12B, the irradiation width of the charge removing light OP to be projected onto the surface of the photosensitive drum 2 is varied between the positions on the surface of the photosensitive drum 2 on the first shortest lines L11, L12, L13, . . . , and the positions on the surface of the photosensitive drum 2 on the second shortest lines L21, L22, . . . . Specifically, as shown in FIG. 12A, in the case where the distance between the end surface 623*e* of the optical path defining member 623B and the surface of the photosensitive drum 2 is set to the first distance d3, diffusivity of the charge removing light OP is relatively small because the first distance d3 is relatively short. Accordingly, the surface of the photosensitive drum 2 is irradiated with a first irradiation width S3, which is a relatively narrow irradiation width. On the other hand, as shown in FIG. 12B, in the case where the distance between the end surface 623*e* and the surface of the photosensitive drum 2 is set to the second distance d4, diffusivity of the charge removing light OP is relatively large because the second distance d4 is relatively long. Accordingly, the surface of the photosensitive drum 2 is irradiated with a second irradiation width S4, which is a relatively large irradiation width.

Varying the irradiation width of the charge removing light OP as mentioned above enables to vary the irradiation time of the charge removing light OP to be projected onto an amorphous silicon layer 202 of the photosensitive drum 2 between the positions on the surface of the photosensitive drum on the first shortest lines L11, L12, L13, . . . , and on the second shortest lines L21, L22, . . . . In other words, in the case where the irradiation width is set to the relatively narrow first irradiation width S3, the time for irradiating the surface of the photosensitive drum 2 by the charge removing light OP is relatively short because the irradiation width is narrow, assuming that the charge removing light OP is projected onto an arbitrary point on the surface of the photosensitive drum 2 which is rotated at a certain circumferential speed. On the other hand, in the case where the irradiation width is set to the relatively wide second irradiation width S4, the time for irradiating the surface of the photosensitive drum 2 by the charge removing light OP is relatively long because the irradiation width is wide.

With this arrangement, the amount of the charge removing light to be projected onto the surface of the photosensitive drum 2 is made axially uniform by controlling the irradiation time of the charge removing light OP as mentioned above, even if a charge removing light amount distribution non-uniformity occurs in association with the positional arrangement of the LEDs 612 of the LED array 61. As mentioned above, the amorphous silicon photoconductor has the characteristic that the generated amount of light carriers is increased as the amount of the charge removing light is increased. Distributing the amount of the charge removing light uniformly in the axial direction of the photosensitive drum 2 as mentioned above enables to secure uniform generation of light carriers.

The third embodiment is constructed as mentioned above for the following reason. As shown in FIGS. 3 and 11, in the case where the LED array 61 is used as a light source, wherein the LEDs 612, serving as point light sources, are arrayed in the axial direction of the photosensitive drum 2, the amount of the charge removing light to be projected along the second shortest lines L21, L22, . . . connecting the midpoints P1, P2, . . . of the adjacent LEDs 612 and the surface of the photosensitive drum 2 is made smaller than the amount of the charge removing light to be projected along the first shortest lines L11, L12, L13, . . . connecting the respective LEDs 612 and the surface of the photosensitive drum 2, because the second distance d4 is longer than the first distance d3. The lowering of the charge removing light amount is increased by increasing the interval between the respective LEDs 612. In other words, if the number of the LEDs 612 is decreased in order to reduce the production cost, fluctuation of the charge removing light amount is increased.

Figure 13:
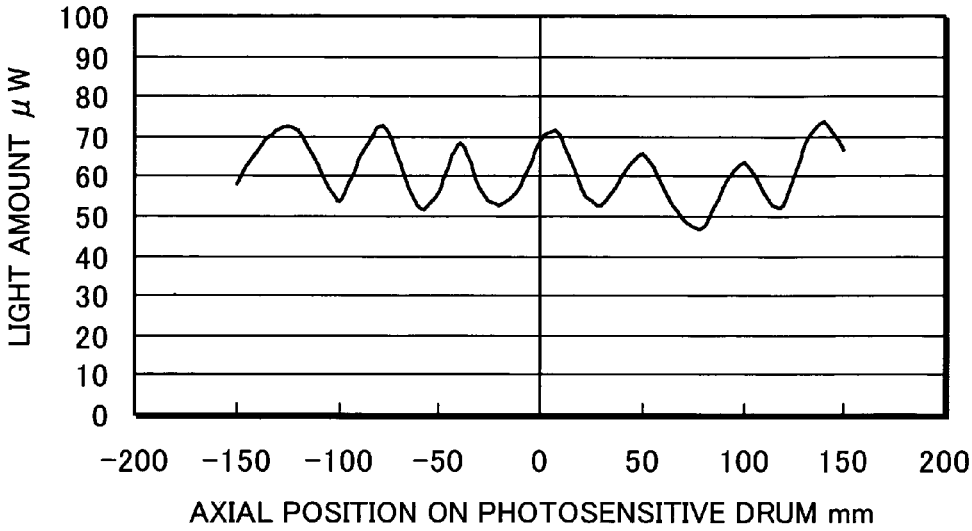
FIG. 13 is a graph showing a light amount distribution of a photosensitive drum in an axial direction thereof in the case where charge removing light is emitted from an LED array, as a light source, with LEDs arrayed in the axial direction of the photosensitive drum at a certain interval in the third embodiment.

FIG. 13 is a graph showing a light amount distribution of a photosensitive drum having an axial length of about 300 mm in the axial direction thereof, in the case where charge removing light is axially projected onto the surface of the photosensitive drum with use of an LED array, as a light source, in which LEDs are arrayed in the axial direction of the photosensitive drum at an interval of about 45 mm, by using a light guiding member having a flat end surface. As is obvious from FIG. 13, the charge removing light to be axially projected onto the surface of the photosensitive drum has a variation of about 15 to 20 μW, and therefore, the light amount distribution is not uniform. Obviously, the charge removing light amount is large on the positions on the surface of the photosensitive drum on the first shortest lines L11, L12, L13, . . . , and the charge removing light amount is small on the positions on the surface of the photosensitive drum on the second shortest lines L21, L22, . . . .

Figure 14:
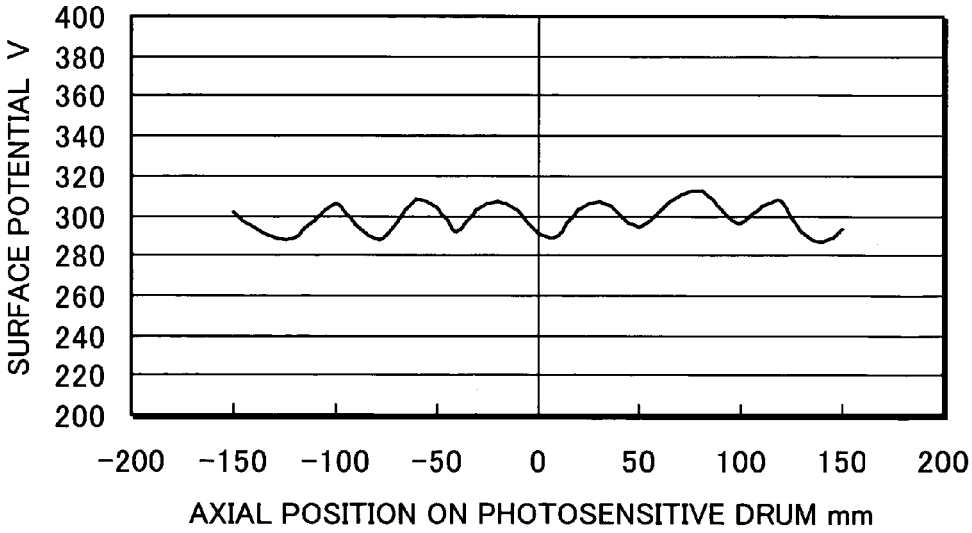
FIG. 14 is a graph showing a surface potential distribution in the axial direction of the photosensitive drum in the case where the photosensitive drum whose surface is projected with the charge removing light according to the light amount distribution shown in FIG. 13 is charged by a charging roller in the third embodiment.

If the light amount distribution is fluctuated in the axial direction of the photosensitive drum as shown in FIG. 13, a charging fluctuation may occur, as shown in FIG. 14 in the case where the photosensitive drum 2 is charged by a downstream charging roller 31 (see FIG. 2), thereby causing a surface potential distribution non-uniformity in the axial direction of the photosensitive drum 2. In the example of FIG. 14, the surface potential of the photosensitive drum 2 on the second shortest lines L21, L22, . . . is smaller than the surface potential thereof on the first shortest lines L11, L12, L13, . . . by about 15 to 20V. Occurrence of such a surface potential distribution non-uniformity may result in an image formation failure such as fog.

In view of the above, in the third embodiment, as shown in FIG. 11, the distance between the end surface 623*e* of the optical path defining member 623B and the surface of the photosensitive drum 2 on the first shortest lines L11, L12, L13, . . . is set to the relatively short first distance d3 to secure the first irradiation width S3, and the distance between the end surface 623*e* of the optical path defining member 623B and the surface of the photosensitive drum 2 on the second shortest lines L21, L22, . . . is set to the relatively long second distance d4 to secure the second irradiation width S3. Also, the end surface 623*e* has the wave-like configuration that the distance between the end surface 623*e* and the surface of the photosensitive drum 2 is gradually increased from the first shortest line L11 toward the second shortest line L21, and is gradually decreased from the second shortest L21 to the first shortest lines L12, and so on. This enables to control the irradiation time of the charge removing light to be projected onto the surface of the photosensitive drum 2, considering the positional arrangement of the LEDs 612, namely, in accordance with the charge removing light amount per unit time at the respective axial points on the surface of the photosensitive drum 2, which is defined in the case where the LED array 61 is used as a light source.

Figure 15:
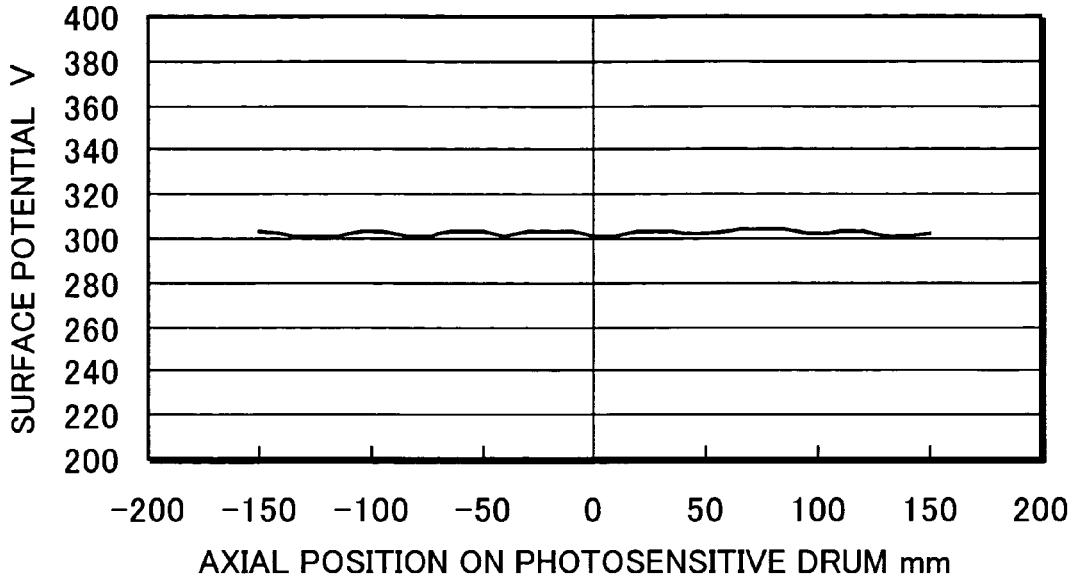
FIG. 15 is a graph showing a surface potential distribution in the axial direction of the photosensitive drum in the case where the photosensitive drum is charged by the charging roller in the third embodiment.

The above control enables to secure uniform generation of light carriers in the amorphous silicon layer 202, thereby preventing occurrence of a surface potential distribution non-uniformity in a charging operation by the charging roller 31. FIG. 15 is a graph showing a surface potential distribution of the photosensitive drum 2 in the axial direction thereof after the charging operation by the charging roller 31. As is obvious from FIG. 15, the surface potential distribution is flat, in other words, the photosensitive drum 2 is free from a surface potential distribution non-uniformity.

In the charge removing unit having the above construction in the third embodiment, in the case where a charge remover provided with a light source, in which a plurality of point light sources i.e. LEDs 612 are arrayed in the axial direction of the photosensitive drum 2, is used, the charge removing light amount is corrected by increasing, with use the light guiding member 62B, the irradiation width on the surface of the photosensitive drum 2 on the second shortest line L21 connecting the midpoint of the adjacent point light sources and the surface of the photosensitive drum, where the light amount is normally lowered if no measure is taken. This arrangement enables to make the amount of the charge removing light to be projected onto the surface of the photosensitive drum 2 substantially uniform in the axial direction of the photosensitive drum 2 without increasing the number of the LEDs 612. Accordingly, this arrangement is advantageous in preventing image formation failure such as fog due to a surface potential distribution non-uniformity in the image forming apparatus provided with the amorphous silicon photosensitive drum.

The third embodiment may be modified as follows.

In the third embodiment, the frame member 106 and the optical path defining member 623B of the light guiding member 62B define the slit-like light transmitting space P. Alternatively, the light transmitting space P may be defined by using various planar members in place using of the frame member 106 and the optical path defining member 623B. In the modification, however, it is desirable to apply a light reflective coat on a surface of the planar members to prevent absorption of the charge removing light. Use of the frame member 106 in the machine main body 100 as described in the embodiment is preferable to keep the number of the components constituting the image forming apparatus from increasing.

In place of defining the slit-like light transmitting space P as in the third embodiment, it is possible to use, for instance, a light guiding film, a light guiding plate, or a like member having a light guiding characteristic by itself, to oppose an incident end of the light guiding film or the light guiding plate to the LED array 61, and to oppose an exit end thereof to the surface of the photosensitive drum 2. In the modification, the irradiation width to be defined on the surface of the photosensitive drum 2 by projection of the charge removing light can be controlled by forming a surface of the exit end of the light guiding film or the light guiding plate into the wave-like configuration as shown in FIG. 11.

In the third embodiment, the end surface 623*e* of the optical path defining member 623B has the wave-like configuration. Alternatively, the end surface 623*e* may be shaped into steps, with the positions on the end surface 623*e* on the first shortest lines L11, L12, L13, . . . being highest, and the positions on the end surface 623*e* on the second shortest lines L21, L22, . . . being lowest.

In the third embodiment, the distance between the end surface 623*e* of the optical path defining member 623B and the surface of the photosensitive drum 2 is axially varied to vary the irradiation width of the charge removing light to be projected onto the surface of the photosensitive drum 2. Alternatively, the irradiation width of the charge removing light may be varied by varying the width of the slit of the light transmitting space P between the positions on the surface of the photosensitive drum 2 on the first shortest lines L11, L12, L13, . . . , and the positions on the surface of the photosensitive drum 2 on the second shortest lines L21, L22, . . . . Specifically, the distance between the frame member 106 and the optical path defining member 623B is set relatively small at the positions corresponding to the first shortest lines L11, L12, L13, . . . , and the distance between the frame member 106 and the optical path defining member 623B is set relatively large at the positions corresponding to the second shortest lines L21, L22, . . . , whereby the amount of the charge removing light to be projected onto the surface of the photosensitive drum 2 is set relatively large at the axially opposite ends of the photosensitive drum 2, as compared with the axially central part thereof.

The invention has been described in the form of the various embodiments and modifications. The invention, however, is not limited to the foregoing, and may be further modified as follows, for instance.

In the foregoing, the copying machine 1 has been described as an example of the inventive image forming apparatus. Alternatively, the invention may be applicable to an image forming apparatus other than the copying machine, such as a facsimile machine and a printer.

In the foregoing, the photosensitive drum 2 has been described as an example of the photoconductor. Alternatively, a belt-shaped photoconductor may be used in place of the photosensitive drum 2. In the modification, the belt-shaped photoconductor is rotatably supported by a driving assembly including a drive roller and a driven roller so that the photoconductor is drivingly circulated by the drive roller. As one approach of the modification, the end surface 623*e* of the optical path defining member 623 may have such a configuration that the distance between the end surface 623*e* and the surface of the photoconductor is gradually varied from opposite ends of the photoconductor in a direction of a rotational axis of the drive roller i.e. a rotational axis of the photoconductor toward an axially central part thereof, as in the first embodiment. As another approach, the light guiding characteristic of the optical path defining member 623A may be gradually varied, as in the second embodiment. As yet another approach, the end surface 623*e* of the optical path defining member 623B may be formed into a wave-like configuration, as in the third embodiment.

To summarize the invention, the image forming apparatus is adapted to form an image by transferring a toner image onto a transfer member. The image forming apparatus comprises: a photoconductor, rotatably supported about a rotational axis thereof, for forming an electrostatic latent image on a surface of the photoconductor, and forming a toner image on the surface of the photoconductor by attracting a toner onto the electrostatic latent image; a charger for charging the photoconductor by contact charging; and a charge remover for removing charge residues from the surface of the photoconductor after the toner image is transferred from the surface of the photoconductor onto the transfer member, wherein the charge remover includes a light source for emitting a certain amount of charge removing light; and a light guiding member for linearly projecting the charge removing light onto the surface of the photoconductor. The light guiding member has an incident end facing the light source, and an exit end facing the surface of the photoconductor. The light guiding member has charge removing light amount controlling means for controlling the amount of the charge removing light to be projected onto the surface of the photoconductor in a direction of the rotational axis of the photoconductor.

Preferably, the charge removing light amount controlling means may control the charge removing light amount by varying an irradiation width of the charge removing light to be projected onto the surface of the photoconductor in the direction of the rotational axis of the photoconductor.

Preferably, at least a central part on the surface of the photoconductor in the direction of the rotational axis thereof may be irradiated with a first irradiation width by the charge removing light emitted through the exit end of the light guiding member, and opposite ends on the surface of the photoconductor in the direction of the rotational axis thereof may be irradiated with a second irradiation width by the charge removing light emitted through the exit end of the light guiding member. The second irradiation width is wider than the first irradiation width.

Preferably, a distance between the exit end of the light guiding member and the surface of the photoconductor on the axially central part thereof may be set to a first distance, and a distance between the exit end of the light guiding member and the surface of the photoconductor on the axially opposite ends thereof may be set to a second distance. The second distance is longer than the first distance.

Preferably, the distance between the exit end of the light guiding member and the surface of the photoconductor may be so set that the distance is gradually increased toward the axially opposite ends of the photoconductor, with the distance between the exit end of the light guiding member and the surface of the photoconductor on the axially central part thereof being shortest.

Preferably, the light guiding member may include an optical path defining member having a width substantially equal to a length of the photoconductor in the direction of the rotational axis thereof, the irradiation width of the charge removing light to be projected onto the surface of the photoconductor being defined by a distance between a distal end of the optical path defining member and the surface of the photoconductor.

Preferably, the light source may include a linear light source constructed by arraying a plurality of point light sources each adapted for emitting the charge removing light in the direction of the rotational axis of the photoconductor, and the charge removing light emitted through the exit end of the light guiding member may be irradiated at least with a first irradiation width onto the surface of the photoconductor on a first shortest line connecting the respective point light sources and the surface of the photoconductor, and with a second irradiation width onto the surface of the photoconductor on a second shortest line connecting a midpoint between the adjacent point light sources and the surface of the photoconductor, wherein the second irradiation width is wider than the first irradiation width.

Preferably, the distance between the exit end of the light guiding member and the surface of the photoconductor may be set to a first distance on the first shortest line, and the distance between the exit end of the light guiding member and the surface of the photoconductor may be set to a second distance on the second shortest line. The second distance is longer than the first distance.

Preferably, the distance between the exit end of the light guiding member and the surface of the photoconductor may be gradually increased toward the second shortest line, with the distance between the exit end of the light guiding member and the surface of the photoconductor being shortest on the first shortest line.

Preferably, the light guiding member may include an optical path defining member having a width substantially equal to a length of the photoconductor in the direction of the rotational axis thereof, the irradiation width of the charge removing light to be projected onto the surface of the photoconductor being defined by a distance between a distal end of the optical path defining member and the surface of the photoconductor.

Preferably, the point light source may include a light emitting diode.

Preferably, the charge removing light amount controlling means may control the charge removing light amount by varying a light guiding characteristic of the charge removing light to be projected onto the surface of the photoconductor from the incident end to the exit end in the direction of the rotational axis of the photoconductor.

Preferably, the light source may include a linear light source for emitting the charge removing light, the light guiding member may have a linear incident end facing the light source, and a linear exit end facing the surface of the photoconductor to linearly irradiate the surface of the photoconductor by the charge removing light in the direction of the rotational axis of the photoconductor, and the light guiding member may transmit the charge removing light from the incident end of the light guiding member through the exit end of the light guiding member in such a manner that the charge removing light to be projected onto the surface of the photoconductor at least on the axially central part thereof has a first light guiding characteristic, and that the charge removing light to be projected onto the surface of the photoconductor on the axially opposite ends thereof has a second light guiding characteristic. The second light guiding characteristic has a light transmittance loss smaller than the first light guiding characteristic.

Preferably, the light guiding member may include a pair of planar members for defining a slit-like light transmitting space between the linear light source and the photoconductor, and a surface of at least the one of the planar members facing the light transmitting space may have at least a first reflectance to the charge removing light on a first shortest line connecting a vicinity of a longitudinal central part of the linear light source and a vicinity of the axially central part of the photoconductor to secure the first light guiding characteristic, and a second reflectance to the charge removing light on a second shortest line connecting a vicinity of longitudinal opposite ends of the linear light source and a vicinity of the axially opposite ends of the photoconductor to secure the second light guiding characteristic.

Preferably, the surface of the one of the planar members facing the light transmitting space may be constituted by combination of a first reflective member and a second reflective member having reflectances different from each other.

Preferably, the first reflective member may have a low reflectance, and the second reflective member has a high reflectance, and the surface of the one of the planar members facing the light transmitting space may be constituted by attaching the second reflective member on the first reflective member as a base member in such a manner that a cross-sectional area of the second reflective member on the first shortest line is smallest, and a cross-sectional area of the second reflective member on the second shortest line is largest.¥

Preferably, the second reflective member may be so configured that the cross-sectional area of the second reflective member is gradually decreased from the largest area on the second shortest line toward the smallest area on the first shortest line.

Preferably, the light guiding member may be operative to control the charge removing light amount in such a manner that the amount of the charge removing light to be projected onto the surface of the photoconductor on the axially central part thereof is set smaller than the amount of the charge removing light to be projected onto the surface of the photoconductor on the axially opposite ends thereof.

Preferably, the charge removing light amount controlling means may control the charge removing light amount in such a manner that the amount of the charge removing light to be projected onto the surface of the photosensitive drum is set substantially uniform in the direction of the rotational axis thereof.

Preferably, the photoconductor may include a photosensitive drum rotatable about the rotational axis thereof.

Preferably, the photoconductor may include an amorphous silicon photoconductor.

This application is based on Japanese Patent Application Nos. 2005-45328, 2005-45334, and 2006-4820 respectively filed on Feb. 22, 2005, Feb. 22, 2005, and Jan. 12, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus for forming an image by transferring a toner image onto a transfer member, the image forming apparatus comprising:

a photoconductor, rotatably supported about a rotational axis thereof, for forming an electrostatic latent image on a surface of the photoconductor, and forming a toner image on the surface of the photoconductor by attracting a toner onto the electrostatic latent image;

a charger for charging the photoconductor by contact charging; and a charge remover for removing charge residues from the surface of the photoconductor after the toner image is transferred from the surface of the photoconductor onto the transfer member, wherein the charge remover includes a light source for emitting a certain amount of charge removing light; and a light guiding member for linearly projecting the charge removing light onto the surface of the photoconductor, the light guiding member having an incident end facing the light source, and an exit end facing the surface of the photoconductor, the light guiding member being operative to control the amount of the charge removing light to be projected onto the surface of the photoconductor in a direction of the rotational axis of the photoconductor.

2. The image forming apparatus according to claim 1, wherein the light guiding member is operative to control the charge removing light amount by varying an irradiation width of the charge removing light to be projected onto the surface of the photoconductor in the direction of the rotational axis of the photoconductor.

3. The image forming apparatus according to claim 2, wherein at least a central part on the surface of the photoconductor in the direction of the rotational axis thereof is irradiated with a first irradiation width by the charge removing light emitted through the exit end of the light guiding member, and opposite ends on the surface of the photoconductor in the direction of the rotational axis thereof are irradiated with a second irradiation width by the charge removing light emitted through the exit end of the light guiding member, the second irradiation width being wider than the first irradiation width.

4. The image forming apparatus according to claim 3, wherein a distance between the exit end of the light guiding member and the surface of the photoconductor on the axially central part thereof is set to a first distance, and a distance between the exit end of the light guiding member and the surface of the photoconductor on the axially opposite ends thereof is set to a second distance, the second distance being longer than the first distance.

5. The image forming apparatus according to claim 4, wherein the distance between the exit end of the light guiding member and the surface of the photoconductor is so set that the distance is gradually increased toward the axially opposite ends of the photoconductor, with the distance between the exit end of the light guiding member and the surface of the photoconductor on the axially central part thereof being shortest.

6. The image forming apparatus according to claim 3, wherein the light guiding member includes an optical path defining member having a width substantially equal to a length of the photoconductor in the direction of the rotational axis thereof, the irradiation width of the charge removing light to be projected onto the surface of the photoconductor being defined by a distance between a distal end of the optical path defining member and the surface of the photoconductor.

7. The image forming apparatus according to claim 2, wherein the light source includes a linear light source constructed by arraying a plurality of point light sources each adapted for emitting the charge removing light in the direction of the rotational axis of the photoconductor, and the charge removing light emitted through the exit end of the light guiding member is irradiated at least with a first irradiation width onto the surface of the photoconductor on a first shortest line connecting the respective point light sources and the surface of the photoconductor, and with a second irradiation width onto the surface of the photoconductor on a second shortest line connecting a midpoint between the adjacent point light sources and the surface of the photoconductor, the second irradiation width being wider than the first irradiation width.

8. The image forming apparatus according to claim 7, wherein the distance between the exit end of the light guiding member and the surface of the photoconductor is set to a first distance on the first shortest line, and the distance between the exit end of the light guiding member and the surface of the photoconductor is set to a second distance on the second shortest line, the second distance being longer than the first distance.

9. The image forming apparatus according to claim 8, wherein the distance between the exit end of the light guiding member and the surface of the photoconductor is gradually increased toward the second shortest line, with the distance between the exit end of the light guiding member and the surface of the photoconductor being shortest on the first shortest line.

10. The image forming apparatus according to claim 7, wherein the light guiding member includes an optical path defining member having a width substantially equal to a length of the photoconductor in the direction of the rotational axis thereof, the irradiation width of the charge removing light to be projected onto the surface of the photoconductor being defined by a distance between a distal end of the optical path defining member and the surface of the photoconductor.

11. The image forming apparatus according to claim 7, wherein the point light source includes a light emitting diode.

12. The image forming apparatus according to claim 1, wherein the light guiding member is operative to control the charge removing light amount by varying a light guiding characteristic of the charge removing light to be projected onto the surface of the photoconductor from the incident end to the exit end in the direction of the rotational axis of the photoconductor.

13. The image forming apparatus according to claim 12, wherein the light source includes a linear light source for emitting the charge removing light, the light guiding member has a linear incident end facing the light source, and a linear exit end facing the surface of the photoconductor to linearly irradiate the surface of the photoconductor by the charge removing light in the direction of the rotational axis of the photoconductor, and the light guiding member transmits the charge removing light from the incident end of the light guiding member through the exit end of the light guiding member in such a manner that the charge removing light to be projected onto the surface of the photoconductor at least on the axially central part thereof has a first light guiding characteristic, and that the charge removing light to be projected onto the surface of the photoconductor on the axially opposite ends thereof has a second light guiding characteristic, the second light guiding characteristic having a light transmittance loss smaller than the first light guiding characteristic.

14. The image forming apparatus according to claim 13, wherein the light guiding member includes a pair of planar members for defining a slit-like light transmitting space between the linear light source and the photoconductor, and a surface of at least the one of the planar members facing the light transmitting space has at least a first reflectance to the charge removing light on a first shortest line connecting a vicinity of a longitudinal central part of the linear light source and a vicinity of the axially central part of the photoconductor to secure the first light guiding characteristic, and a second reflectance to the charge removing light on a second shortest line connecting a vicinity of longitudinal opposite ends of the linear light source and a vicinity of the axially opposite ends of the photoconductor to secure the second light guiding characteristic.

15. The image forming apparatus according to claim 14, wherein the surface of the one of the planar members facing the light transmitting space is constituted by combination of a first reflective member and a second reflective member having reflectances different from each other.

16. The image forming apparatus according to claim 15, wherein the first reflective member has a low reflectance, and the second reflective member has a high reflectance, and the surface of the one of the planar members facing the light transmitting space is constituted by attaching the second reflective member on the first reflective member as a base member in such a manner that a cross-sectional area of the second reflective member on the first shortest line is smallest, and a cross-sectional area of the second reflective member on the second shortest line is largest.

17. The image forming apparatus according to claim 16, wherein the second reflective member is so configured that the cross-sectional area of the second reflective member is gradually decreased from the largest area on the second shortest line toward the smallest area on the first shortest line.

18. The image forming apparatus according to claim 1, wherein the light guiding member is operative to control the charge removing light amount in such a manner that the amount of the charge removing light to be projected onto the surface of the photoconductor on the axially central part thereof is set smaller than the amount of the charge removing light to be projected onto the surface of the photoconductor on the axially opposite ends thereof.

19. The image forming apparatus according to claim 1, wherein the light guiding member is operative to control the charge removing light amount in such a manner that the amount of the charge removing light to be projected onto the surface of the photosensitive drum is set substantially uniform in the direction of the rotational axis thereof.

20. The image forming apparatus according to claim 1, wherein the photoconductor includes a photosensitive drum rotatable about the rotational axis thereof.

21. The image forming apparatus according to claim 1, wherein the photoconductor includes an amorphous silicon photoconductor.

* * * * *